US006511362B1

(12) United States Patent
Akaike et al.

(10) Patent No.: US 6,511,362 B1
(45) Date of Patent: Jan. 28, 2003

(54) POLISHING APPARATUS AND POLISHING METHOD

(75) Inventors: Yoshifumi Akaike, Tokyo (JP); Takashi Suzuki, Kanagawa (JP); Hiroyuki Nagai, Tokyo (JP)

(73) Assignee: Sony Corporation (JP)

( * ) Notice: Subject to any disclaimer, the term of this patent is extended or adjusted under 35 U.S.C. 154(b) by 59 days.

(21) Appl. No.: 09/717,103

(22) Filed: Nov. 22, 2000

(30) Foreign Application Priority Data

Nov. 26, 1999 (JP) ..... 11-336795

(51) Int. Cl.[7] ..... B24B 49/00
(52) U.S. Cl. ..... 451/5; 451/290; 451/41
(58) Field of Search ..... 451/5, 41, 283, 451/285, 286, 287, 288, 289, 290, 343, 8, 9, 218, 259, 340

(56) References Cited

U.S. PATENT DOCUMENTS 6,116,987 A * 9/2000 Kubo ..... 451/264
6,165,057 A * 12/2000 Gill, Jr. ..... 451/287
6,183,342 B1 * 2/2001 Watanabe et al. ..... 451/10
6,220,945 B1 * 4/2001 Hirokawa et al. ..... 451/287
6,354,907 B1 * 3/2002 Satoh et al. ..... 451/10

* cited by examiner

*Primary Examiner*—Eileen P. Morgan
*Assistant Examiner*—Hadi Shakeri
(74) *Attorney, Agent, or Firm*—Rader, Fishman & Grauer PLLC; Ronald P. Kananen, Esq.

(57) ABSTRACT

A polishing apparatus and a polishing method capable of suppressing an excessive polishing of an outer circumferential edge surface of a surface to be polished of a polished object to be polished due to elastic deformation of a polishing tool and capable of stabilizing a polishing rate, wherein polishing is carried out by inclining a shaft of a polishing tool with an angle α toward a direction of advance of the movement of the polishing tool to a direction perpendicular to a holding surface of a rotation table, then inclining the shaft of the polishing tool in a direction reducing elastic deformation of a polishing surface in a region where the polishing surface rides up on an outer circumferential edge of a surface to be polished of a wafer to the direction perpendicular to the holding face.

27 Claims, 18 Drawing Sheets

POLISHING APPARATUS AND POLISHING METHOD

BACKGROUND OF THE INVENTION

1. Field of the Invention

The present invention relates to a polishing apparatus and a polishing method.

2. Description of the Related Art

Along with higher integration and multiple layer interconnection of semiconductor devices, flattening of various inter-layer insulation films or other films has become important in the process of production of a semiconductor device.

A variety of means have been proposed as a flattening technology. In recent years, attention has been paid to chemical mechanical polishing (CMP) using the mirror-like polishing technology of silicon wafers. Methods of flattening utilizing this are being developed.

An example of a polishing apparatus using a CMP process as a background of the present invention will be described with reference to FIG. 1.

A polishing apparatus 301 shown in FIG. 1 has a main shaft spindle 303 for rotating a polishing tool 302 and a table 304 for holding a wafer W.

The table 304 is rotatably mounted on a slider 306 provided to be able to move in an X-axial direction along a rail 305. It is driven to rotate by a rotation driving means constituted by for example a motor, a pulley, a belt, etc.

The main shaft spindle 303 is held to be movable in a Z-axial direction and is positioned at a target position in a Z-axial direction by a not illustrated drive mechanism.

In the polishing apparatus 301 having the above constitution, first, the wafer W is rotated at a predetermined speed. Slurry obtained by mixing a polishing abrasive such as silicon oxide into a liquid such as an aqueous solution of potassium hydroxide is fed as an abrasive from a not illustrated slurry feeder onto the wafer W.

Next, the polishing tool 302 is rotated at a predetermined speed, and the wafer W and the polishing tool 302 are positioned in the X-axial and Z-axial directions so that an outer circumferential edge of the polishing tool 302 overlaps and contacts the outer circumferential edge surface of the wafer W.

The polishing tool 302 is positioned in the Z-axial direction so as to obtain a predetermined depth of cut to the wafer W. Due to this, a predetermined polishing pressure is generated between the polishing tool 302 and the wafer W. In this state, the wafer W is moved in the X-axial direction with a predetermined speed pattern. The wafer W is polished while bringing the polishing tool 302 in contact with the wafer W, whereby the wafer W is flattened.

Summarizing the disadvantages, in the polishing apparatus 301 of the above configuration, the polishing surface 302*a* of the polishing tool 302 is parallel to the holding surface of the rotation table 304, and the overlapping regions of the polishing surface 302*a* of the polishing tool 302 and a surface to be polished of the wafer W contact each other over their entire surfaces according to the relative movement of the polishing tool to the wafer W 302 in the X-axial direction. For this reason, the area of the effective working region of the polishing surface 302*a* of the polishing tool 302 to the surface to be polished of the wafer W becomes a region where the polishing surface 302*a* of the polishing tool 302 and the surface to be polished of the wafer W overlap.

This area is relatively large and varies according to the relative movement of the polishing tool 302 in the X-axial direction.

When the area of the effective working region of the polishing surface 302*a* of the polishing tool 302 to the surface to be polished of the wafer W is large, the amount of polishing in the effective working region is apt to be uneven due to the irregularities of the surface to be polished of the wafer W. If the area of the effective working region varies, the amount of polishing per unit time, that is, the polishing rate, varies, so it is difficult to uniformly polish the surface to be polished of the wafer W. Further, when the polishing surface 302*a* of the polishing tool 302 and the surface to be polished of the wafer W are parallel, the slurry cannot easily penetrate between the polishing surface 302*a* of the polishing tool 302 and the surface to be polished of the wafer W, so the amount of polishing again sometimes does not become stable.

For this reason, in the related art, for example, as shown in FIG. 2A, the polishing was performed by inclining a axis K1 of the polishing tool 302 toward the direction of advance of the polishing tool 302 by an inclination angle $\alpha$.

Here, FIG. 3 is a view of the distribution of pressure generated between the polishing surface 302 a of the polishing tool 302 and the surface to be polished of the wafer W when the axis K1 of the polishing tool 301 is inclined in the direction of advance of the movement of the polishing tool 302. Note that FIG. 3 shows the distribution of virtual pressure when polishing the surface to be polished of the wafer W by just rotating the polished tool 302 without rotating the wafer W.

As shown in FIG. 3, the distribution of the pressure generated between the polishing surface 302*a* of the polishing tool 302 and the surface to be polished of the wafer W becomes an approximately crescentic region PR. In this crescentic region PR, an area PH where the pressure is relatively high is generated inside and an area PL where the pressure existing around this is relatively low is generated. The area PH where the pressure is relatively high exhibits an approximately symmetric shape about the X-axis. This area PH becomes a region effectively acting upon the surface to be polished of the wafer W. The area PH is made sufficiently smaller than the overlapping area of the wafer W and the polishing surface 302*a* of the polishing tool 302. Even if the polishing tool 302 moves relatively in the X-axial direction, the surface area of the area PH becomes approximately constant. For this reason, the amount of polishing in the effective working region can be made uniform, and the polishing rate can be made constant.

However, the polishing tool 302 is for example an elastic member made of for example a disk-shaped member and formed by polyurethane foam or other plastic. It is pressed against the surface of the wafer W by a polishing pressure F as shown in FIG. 3. For this reason, the polishing tool 302 pressed against the wafer W resiliently deforms.

In addition, if the polishing surface 302*a* of the polishing tool 302 is inclined to the wafer W surface by the inclination angle $\alpha$, the polishing surface 302*a* of the polishing tool 302 deforms in a riding region 190 and a relief region 191 shown in FIG. 3 as shown in for example FIGS. 4A and 4B when riding up on the wafer W. In the riding region 190, as shown in FIG. 4A, the polishing surface 302*a* of the polishing tool 302 rides up on the surface of the wafer W from an outer circumferential edge EG of the wafer W, so the polishing surface 302*a* of the polishing tool 302 resiliently deforms and the polishing surface 302*a* immediately before the riding up on the surface of the wafer W located in the vicinity of the outer circumferential edge EG protrudes downward from the surface of the wafer W. In the relief region 191, as shown in FIG. 4B, the polishing surface 302*a* of the polishing tool 302 passes the outer circumferential edge EG from the top of the surface of the wafer W and then separates from it, so the resiliently deformed polishing surface 302*a* of the polishing tool 302 separates from the outer circumferential edge EG of the wafer W and the deformation is restored while the stress is eased.

When the polishing surface 302*a* of the polishing tool 302 resiliently deforms, the portion of the polishing surface 302*a* protruding downward from the surface of the wafer W strongly contacts the outer circumferential edge EG of the wafer W, the majority of the working energy is consumed for the work of the protruding portion of the polishing surface 302*a* riding up on the outer circumferential edge EG of the wafer W, and, as shown in FIG. 3, damage DM is given to the outer circumferential edge of the wafer W.

When damage to the outer circumferential edge EG of the wafer W due to the protruding portion of the polishing surface 302*a* accumulates, since the wafer W is rotating, for example, as shown in FIG. 5, an excessively polished portion 402*a* is formed at the entire area of the outer circumferential portion of the wafer W. When the excessively polished portion 402 is formed, there is the disadvantage that the number of semiconductor chips formed on a wafer W and able to be taken becomes small, so the yield is lowered.

The amount of the wafer W surface polished away per unit time, that is, the polishing rate, is lowered by the amount of the working energy consumed for the excessive polishing of the outer circumferential edge EG of the wafer W, the number of wafers W polished per unit time is lowered, and therefore the productivity is lowered.

In the region where the polishing surface 302*a* of the polishing tool 302 rides up on the outer circumferential edge EG of the wafer W, the slurry cannot easily penetrate between the polishing surface 302*a* and the surface of the wafer W, so the slurry fed between the polishing surface 302*a* and the wafer W becomes insufficient and therefore the polishing rate is lowered. In order to make up for the shortage of slurry, a large amount of expensive slurry must be fed, so the productivity is lowered.

In the region where the polishing surface 302*a* of the polishing tool 302 rides up on the outer circumferential edge EG of the wafer W, the damage to the polishing surface 302*a* is also large, the quality of the polishing surface 302*a* is apt to abruptly deteriorate, and therefore fluctuation of the polishing conditions easily occurs. In order to prevent the fluctuation of the polishing conditions, it is necessary to condition the polishing surface 302*a* by a means such as dressing. If the frequency of the conditioning for achieving a suitable state of the polishing surface 302*a* increases, the productivity of the polishing apparatus is lowered.

SUMMARY OF THE INVENTION

An object of the present invention is to provide a polishing apparatus and a polishing method capable of suppressing excessive polishing of the outer circumferential edge of a surface to be polished of a polished object due to elastic deformation of the polishing tool and capable of stabilizing the polishing rate.

According to a first aspect of the present invention, there is provided a polishing method for rotating a polishing tool formed by an elastic member having a polishing surface along a plane perpendicular to a rotary shaft, pressing the polishing surface to a surface to be polished of an object to be polished held on a holding table, and relatively moving the object to be polished and the polishing tool along a holding surface of the holding table, to polish the surface of the object to be polished, said method comprising the steps of: inclining the rotary shaft of the polishing tool by a predetermined angle to a direction perpendicular to the holding surface of the holding table and toward a direction of advance of the movement of the polishing tool, and inclining the shaft of the polishing tool to the direction perpendicular to the holding surface of the holding table and in a direction reducing elastic deformation of the polishing surface in a region where the polishing surface rides up on an edge of the surface.

The polishing is carried out by interposing an abrasive between the polishing surface and the surface to be polished.

Preferably, the shaft is inclined along a plane perpendicular to the direction of advance of the movement of the polishing tool to reduce the elastic deformation of the polishing surface.

Further, preferably, the shaft is inclined in a direction where the height of the polishing surface with respect to the surface to be polished in the region of the polishing surface riding up on the outer circumferential edge of the surface to be polished becomes higher than the height of the polishing surface in a region of the surface to be polished away from the surface to be polished.

Preferably, the polishing is carried out by using a polishing tool having an annular polishing surface.

Use is made of a polishing tool having a polishing surface faced by making the polishing tool rotating in a state with the shaft inclined in different directions relatively move along a correction surface of a correction tool parallel to the holding surface.

According to a second aspect of the present invention, there is provided a polishing method for rotating a polishing tool formed by an elastic member having a polishing surface along a plane perpendicular to a rotary shaft, pressing the polishing surface to a surface to be polished of an object to be polished held on a holding table, and relatively moving the object to be polished and the polishing tool along a holding surface of the holding table, to polish the surface of the object to be polished, said method comprising the steps of: inclining the shaft of the polishing tool to the direction perpendicular to the holding surface of the holding table and in a direction reducing elastic deformation of the polishing surface in a region where the polishing surface rides up on an edge of the polished surface.

According to a third aspect of the present invention, there is provided a polishing apparatus comprising: a holding table for holding an object to be polished, a polishing tool having a polishing surface vertical to a rotatable shaft, a polishing tool holding means for holding the polishing tool rotatably about the shaft, a moving and positioning means for holding the polishing tool holding means in a direction where the polishing surface of the polishing tool faces the surface of the object and determining a relative position of the polishing surface to the surface in the facing direction, and a relative moving means for relatively moving the polishing tool and the object on the holding table along the holding surface of the holding table, wherein the rotary shaft of the polishing tool is inclined at a predetermined angle in a direction from a direction perpendicular to the holding surface of the holding table toward the direction of advance of the movement of the polishing tool and is inclined by a predetermined angle in a direction different from that inclination direction and reducing the elastic deformation of the polishing surface in the region where the polishing surface rides up on the outer circumferential edge of the surface to be polished.

In the present invention, since the polishing is carried out by inclining the polishing tool in a direction reducing the elastic deformation of the polishing surface in the region where the polishing surface rides up on the outer circumferential edge of the surface to be polished of the object to be polished, the damage exerted upon the outer circumferential edge of the surface to be polished due to the elastic deformation by the polishing surface riding up on the outer circumferential edge of the surface to be polished is suppressed, so concentration of a working energy of the polishing surface at the outer circumferential edge of the surface to be polished is suppressed. As a result, the reduction of the polishing rate is suppressed.

Further, by inclining the polishing surface to the surface to be polished, the height of the polishing surface to the surface to be polished in the riding region becomes relatively high, therefore when the abrasive to be interposed between the polishing surface and the surface to be polished is fed, the abrasive can easily penetrate between the polishing surface and the surface to be polished in the riding region toward the rotation direction of the polishing surface, so a sufficient amount of the abrasive is stably fed between the polishing surface and the surface to be polished.

Further, by inclining the shaft of the polishing tool to a direction vertical to the holding surface of the holding table by a predetermined angle toward the direction of advance of the polishing tool, the effective contact area of the polishing surface and the surface to be polished is made narrower. Due to this, unevenness of the distribution of the amount of polishing of the surface to be polished in the contact area is suppressed and variation of the amount of polishing in the surface to be polished is suppressed. On the other hand, when the rotary shaft of the polishing tool is inclined by a predetermined angle to a direction perpendicular to the holding surface of the holding table toward the direction of advance of the movement of the polishing tool, at the forward portion of the polishing surface in the direction of advance of the movement of the polishing tool, a larger elastic deformation occurs in the region riding up on the surface to be polished than a case where there is no inclination and the damage exerted upon the outer circumferential edge of the surface to be polished will increase, but in the present invention, the shaft of the polishing tool is inclined in a direction of reducing the elastic deformation in the riding region of the polishing surface, so the damage exerted upon the outer circumferential edge of the surface to be polished can be suppressed.

Further, in the present invention, by polishing using the polishing tool with the polishing surface inclined to the plane perpendicular to the shaft at approximately the same angle as the inclination angle toward the direction of advance of the movement of the polishing tool, the polishing surface becomes a curved surface, the effective contact area of the polishing surface and the surface to be polished is made narrower, and the height of the polishing surface to the surface to be polished in the region riding up on the surface to be polished becomes high, the amount of elastic deformation of the polishing surface is further reduced and the damage exerted upon the outer circumferential edge of the surface to be polished due to the elastic deformation of the polishing surface can be further suppressed.

BRIEF DESCRIPTION OF THE DRAWINGS

These and other objects and features of the present invention will become clearer from the following description of the preferred embodiments given with reference to the accompanying drawings, in which:

FIGS. 15A and 15B are views of a state of the polishing surface of the polishing tool, wherein FIG. 15A is a sectional view of the state in a riding region 90, and FIG. 15B is a sectional view of the state in a relief region;

DESCRIPTION OF THE PREFERRED EMBODIMENTS

Figure 1:
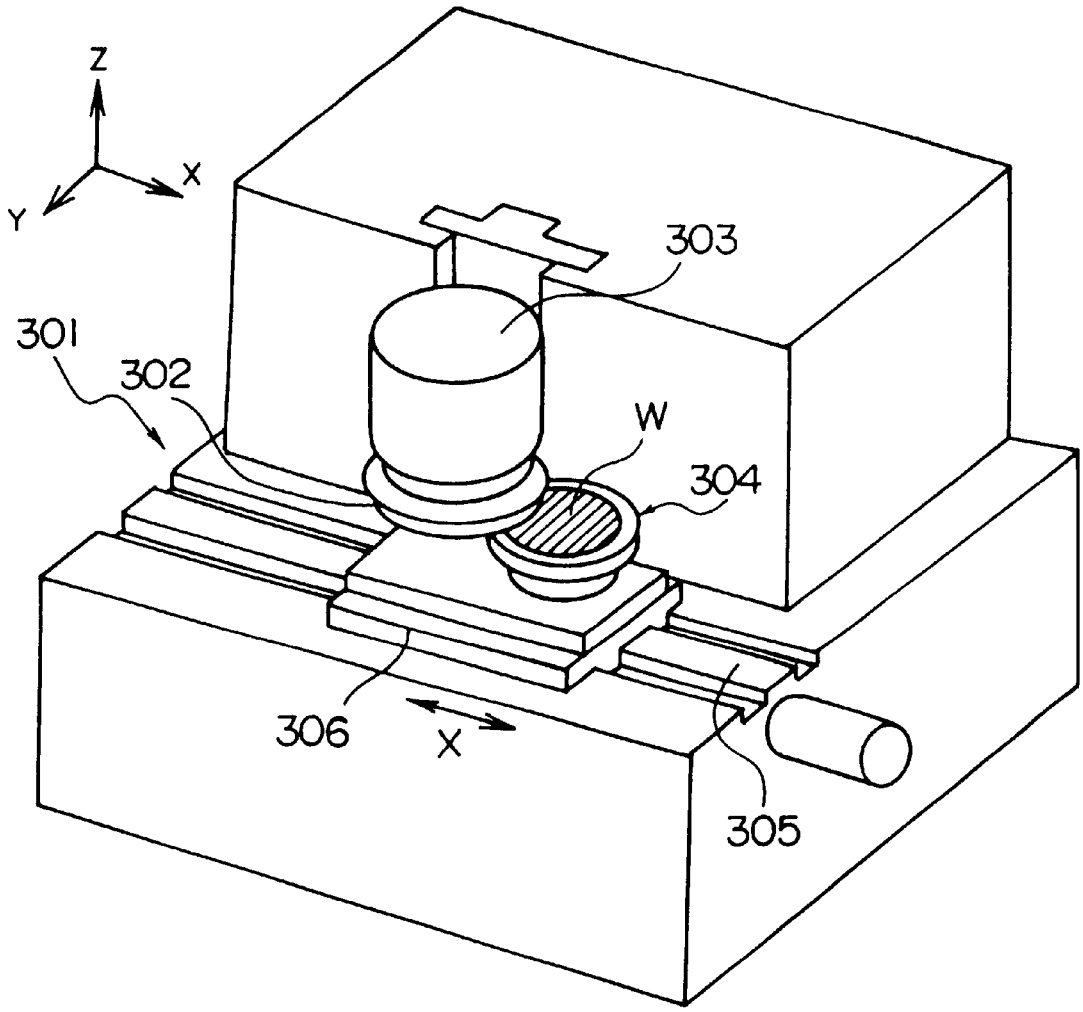
FIG. 1 PRIOR ART
FIG. 1 is a perspective view of an example of a polishing apparatus of the related art.
Figure 2:
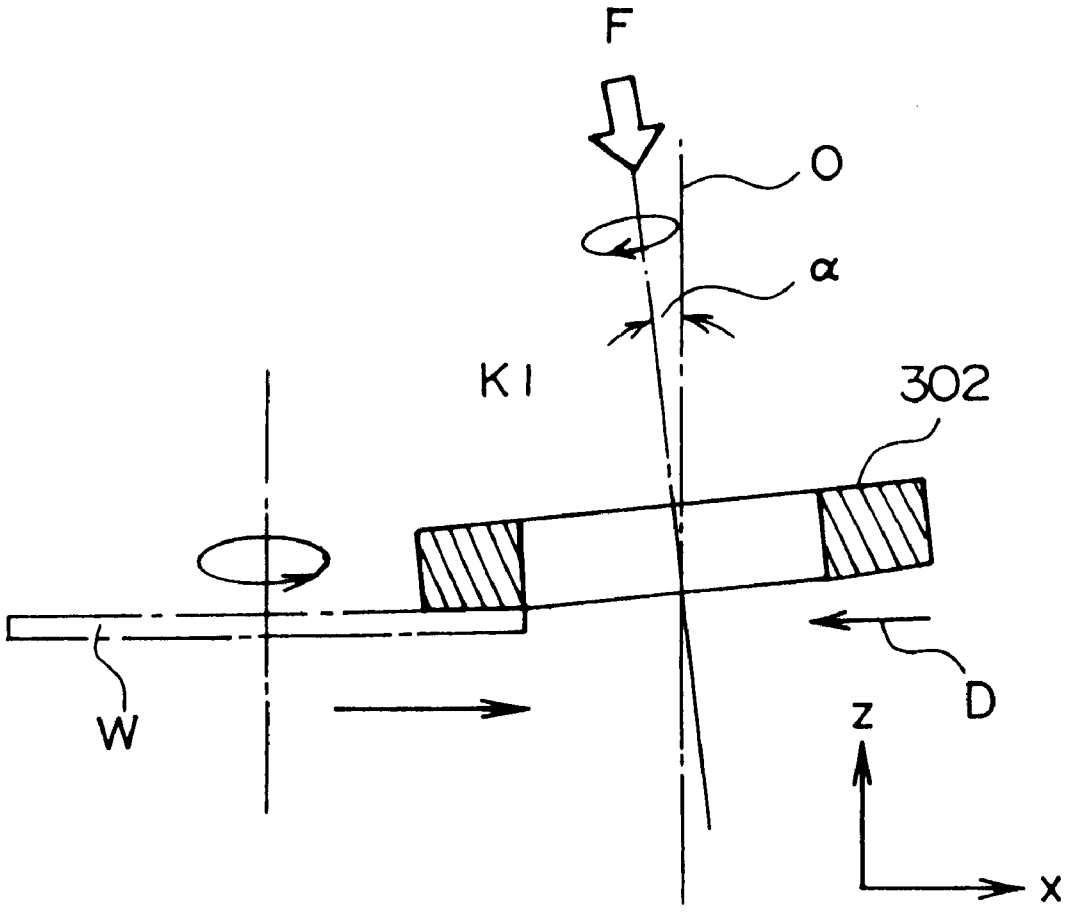
FIG. 2 PRIOR ART
FIG. 2 is a view for explaining an example of a polishing method of the related art.
Figure 3:
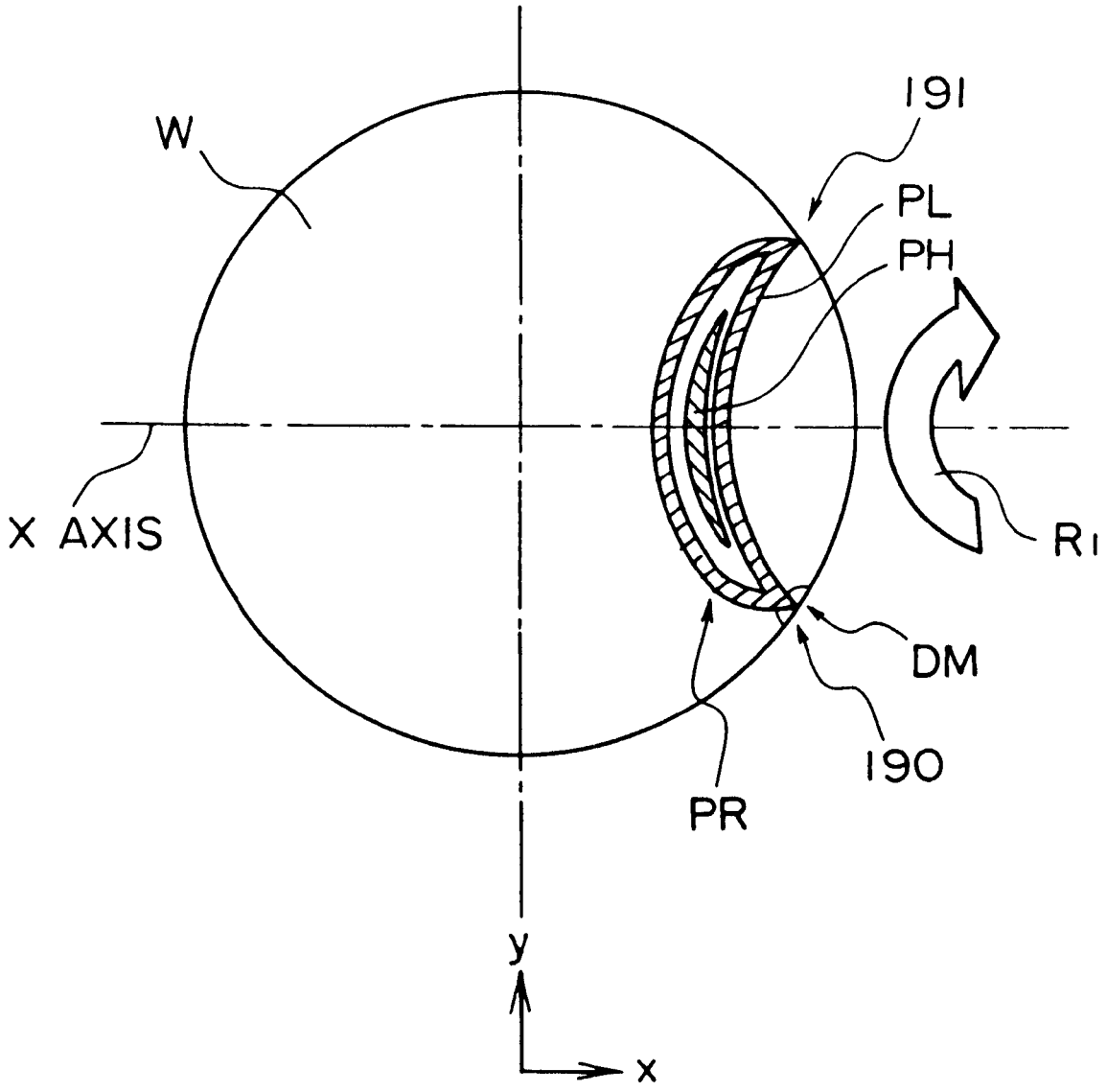
FIG. 3 PRIOR ART
FIG. 3 is a view of an example of distribution of pressure generated between a wafer and the polishing tool in the polishing method shown in FIG. 2.
Figure 4A:
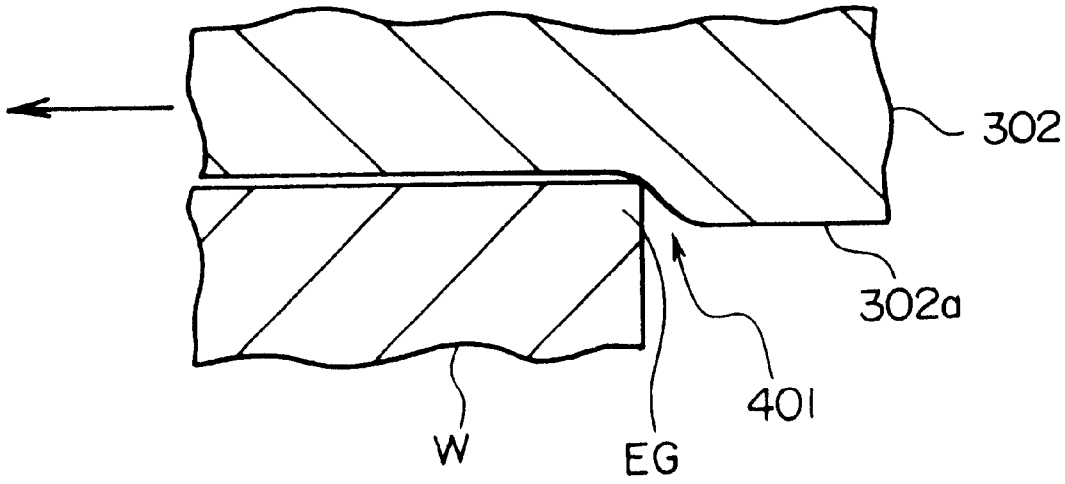
FIG. 4A PRIOR ART
FIGS. 4A and 4B are sectional views of elastic deformation at a wafer outer circumferential edge generated due to pressing of the polishing surface of the polishing tool against the wafer.
Figure 4B:
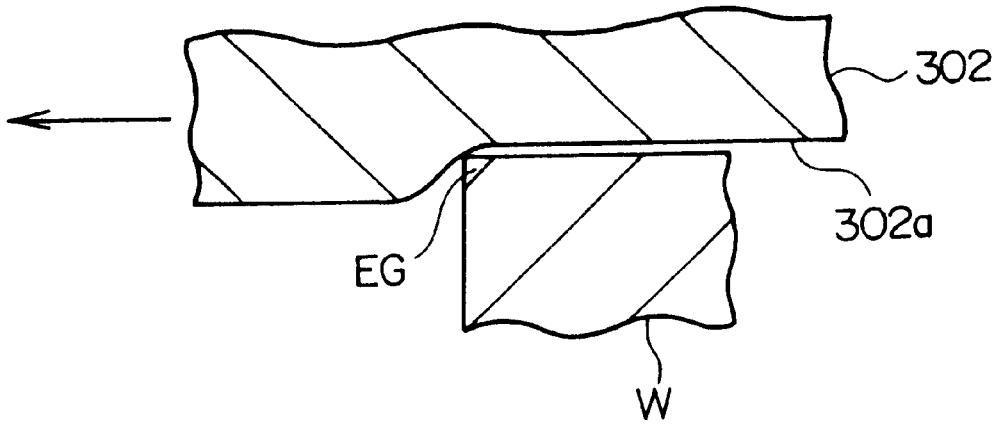
FIG. 4B PRIOR ART
Figure 5:
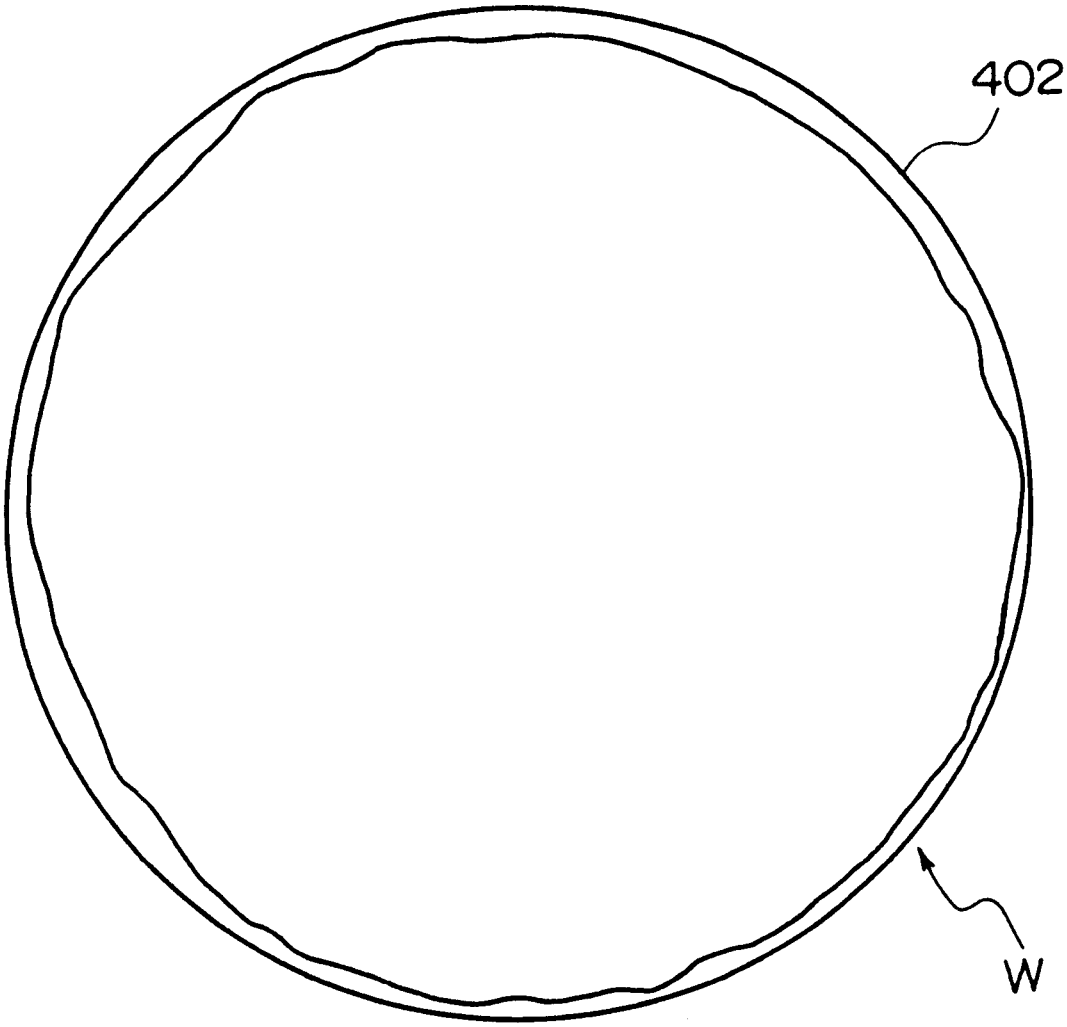
FIG. 5 PRIOR ART
FIG. 5 is a plan view of the state of excessive polishing of the outer circumferential edge of the wafer W occurring due to the elastic deformation of the polishing surface of the polishing tool.

Below, embodiments of the present invention will be explained in detail by referring to the drawings.

First Embodiment

Figure 6:
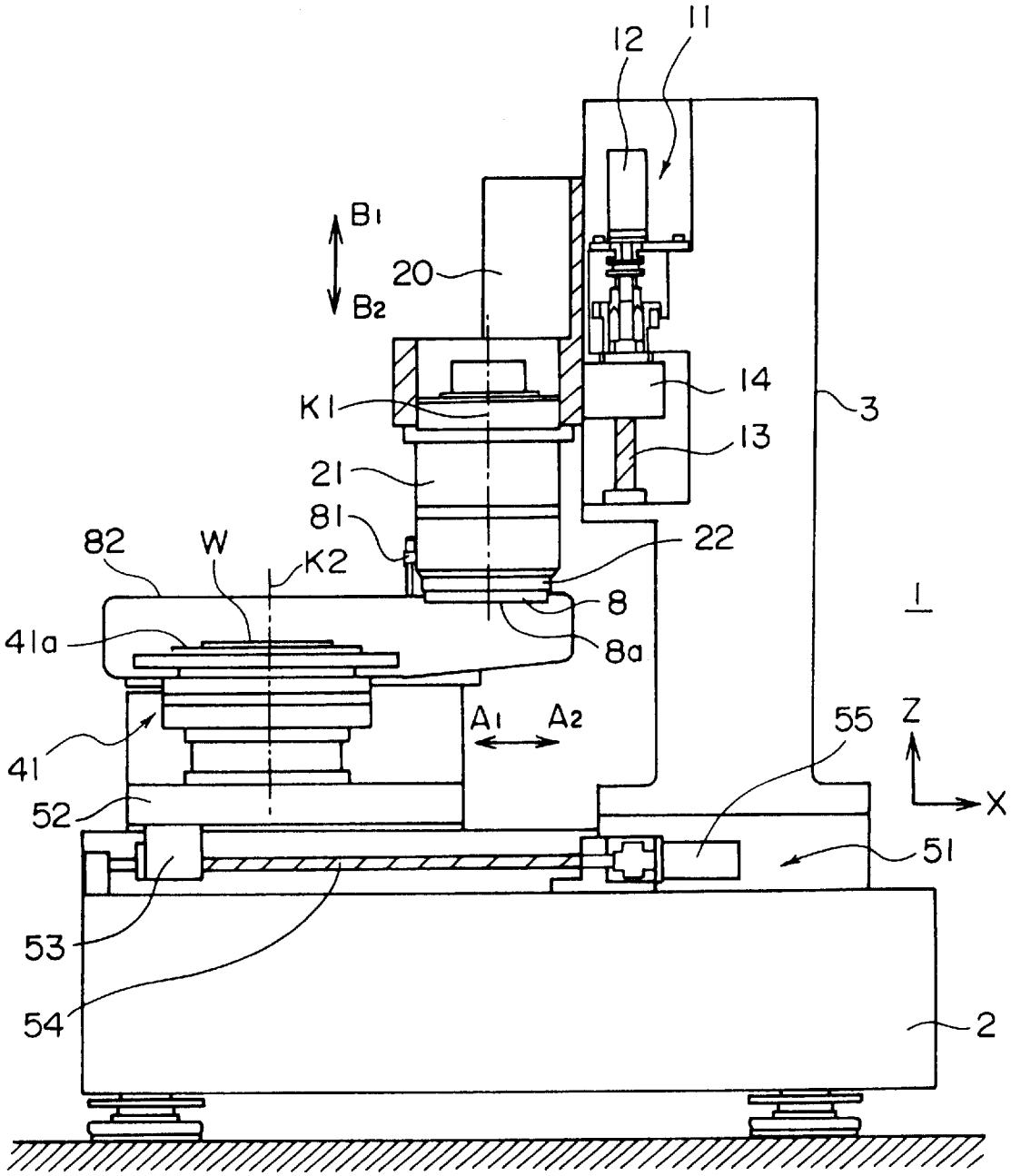
FIG. 6 is a view of the configuration of a polishing apparatus according to an embodiment of the present invention.

FIG. 6 is a view of the configuration of a polishing apparatus according to a first embodiment of the present invention.

The polishing apparatus 1 shown in FIG. 6 is provided with a polishing tool 8, a main shaft spindle 21 for rotatably holding the polishing tool 8, a Z-axis movement mechanism 11 for moving and positioning the main shaft spindle 21 in the Z-axial direction, a rotation table 41 for holding and rotating the wafer W, and an X-axial movement mechanism 51 for moving the rotation table 41 in the X-axial direction.

The main shaft spindle 21 holds the polishing tool 8 and rotates this polishing tool 8 about an axis K1. This main shaft spindle 21 houses inside it a main shaft 23, a static pressure bearing for rotatably holding this main shaft 23, and'servo motor for rotating the main shaft 22. Further, the main shaft spindle 22 is held at a spindle holder 20. The spindle holder 20 is held to a column 3 movably along the Z-axis direction by a not illustrated guide.

Further, at a predetermined position on the outer circumference of the main shaft spindle 21 is provided a slurry/pure water feed nozzle 81 for feeding the slurry serving as the abrasive and pure water onto the wafer W.

The Z-axial movement mechanism 11 is provided along the Z-axial direction (vertical direction) in the gate type column 3 vertically standing on a base 2 and holds the main shaft spindle 21 movably in the Z-axial direction. The Z-axial movement mechanism 11 acts as a movement and positioning means for holding the polishing tool in a direction where the polishing surface 8*a* of the polishing tool 8 faces the surface to be polished of the wafer W and determining the relative position of the polishing surface 8*a* to the surface to be polished of the wafer W in the facing direction.

Specifically, the Z-axial movement mechanism 11 is provided with a servo motor 12 fixed to the column 3, a screw shaft 13 connected to the servo motor 12 and formed with a thread, and a Z-axial slider 14 formed with a screw portion engaging with the screw shaft 13 and connected to the spindle holder 20.

By driving the servo motor 12 to rotate, the Z-axial slider 14 moves upward or downward along the Z-axial direction, and the spindle holder 20 connected to the Z-axial slider 14 moves upward or downward along the Z-axial direction. Due to this, by controlling the amount of rotation of the servo motor 12, the polishing tool 8 can be positioned in the Z-axial direction.

The rotation table 41 is provided with a holding surface 41*a* provided parallel to a horizontal direction for holding the wafer W serving as the polished object and chucks the wafer W with the holding surface 41*a* by a chucking means such as suction. The rotation table 41 is provided with a driving means such as a motor and rotates the wafer W. Note that the rotation table 41 corresponds to a concrete example of the holding table of the present invention. At the periphery of the rotation table 41 is provided a recovery pan 82 for recovering the slurry fed onto the wafer W from the slurry/pure water feed nozzle 81.

The X-axial movement mechanism 51 is provided with a servo motor 55, a screw shaft 54 connected to the servo motor 55 and formed with a thread, an X-axial slider 53 formed with a screw portion engaging with the screw shaft 54, and an X-axial table 52 connected to the X-axial slider 53, held by the not illustrated guide movably in the X-axial direction, and having the rotation table 41 disposed thereon.

This X-axial movement mechanism 51 holds the rotation table 41 and serves as the relative moving means of the present invention for relatively moving the polishing tool 8 and the wafer W along the holding surface 41*a* of the rotation table 41.

Namely, by rotating the servo motor 55, the X-axial slider 53 moves in either direction of the X-axial direction, the X-axial table 52 moves in either direction in the X-axial direction, and the holding surface 41*a* of the rotation table 41 moves in either direction-in the X-axial direction along the horizontal surface, therefore the wafer W and the polishing tool 8 relatively move along the holding surface 41*a* of the rotation table 41.

The polishing tool 8 is a cylindrical member made of an elastic member fixed to a bottom end face of the main shaft 22 and resiliently deforming when pressed against the wafer W. As the material for forming the polishing tool 8, use can be made of a plastic such as polyurethane foam or fixed abrasive made of for example cerium oxide ($CeO_2$) bonded by a soft binder. As the soft binder, use can be made of for example a melamine resin, a urethane resin, or a phenol resin.

The polishing tool 8 has an annular end face parallel to a plane perpendicular to the axis K1 at the bottom end face of the cylindrical member. This forms the polishing surface 8*a* for polishing the surface to be polished of the wafer W.

As the polishing tool 8, use can be made of one having dimensions of for example a diameter of 200, a width of 20, and a thickness of 20 (mm) when polishing a wafer having a diameter of 8 inches. Namely, the diameter of the wafer W and the outer diameter of the polishing tool 8 are approximately the same.

Inclination Mechanism of the Axis K1

Figure 7:
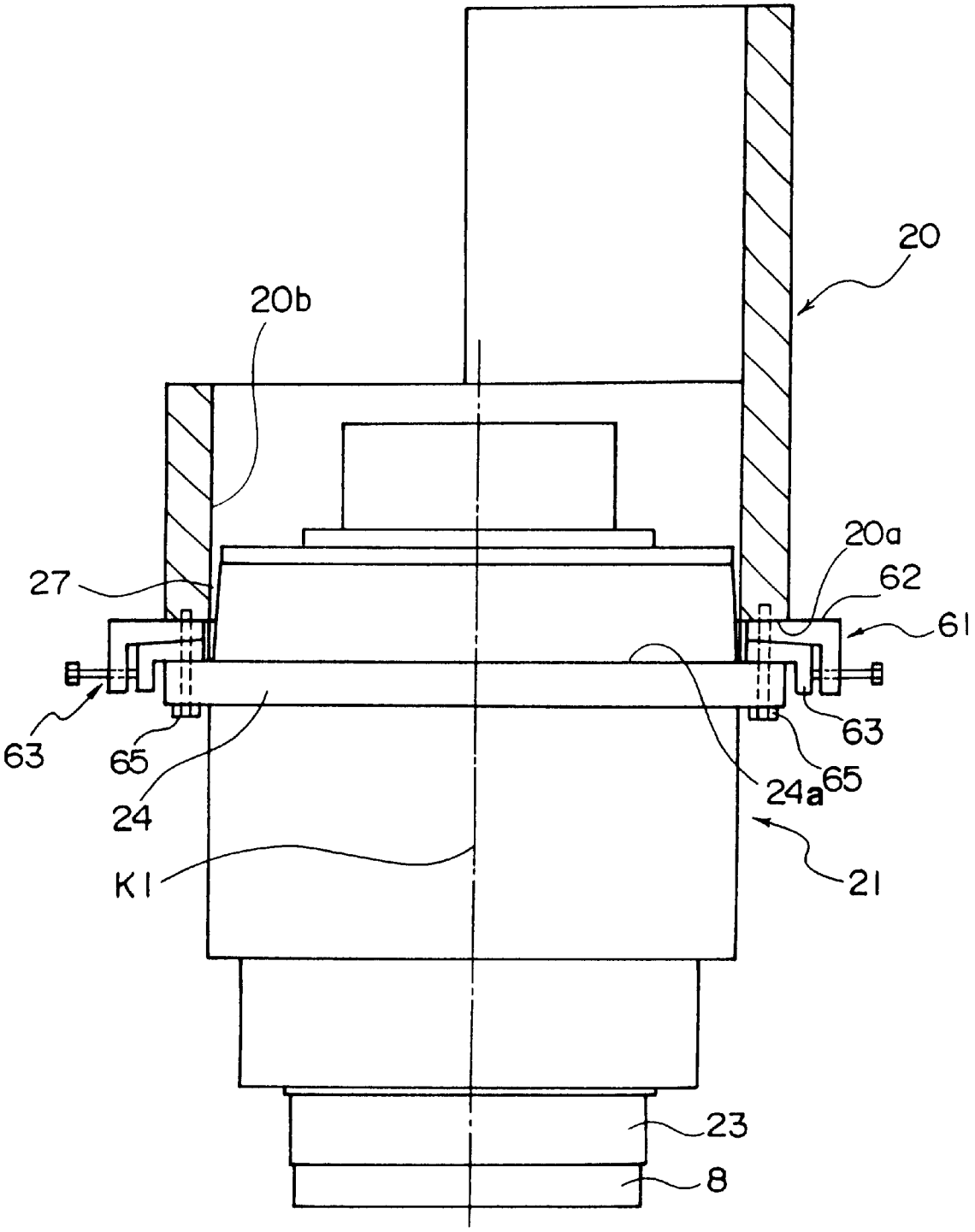
FIG. 7 is a view explaining shaft inclination mechanisms according to a shaft inclining means of the present invention.

FIG. 7 is a view for explaining shaft inclination mechanisms provided between the main shaft spindle 21 and the spindle holder 20 of the polishing apparatus 1 having the above configuration and for adjusting the amount of the inclination of the axis K1 of the main shaft spindle 21 (polishing tool 8) to a axis K2 vertical to the holding surface 41*a* of the rotation table 41.

In FIG. 7, a flange portion 24 is formed on the outer circumference of the main shaft spindle 21. An insertion shaft 27 of the main shaft spindle 21 above the flange portion 24 has a parallel section at a position near the flange portion 24 and a tapered section which becomes narrower upward. An engagement hole 20*b* of the spindle holder 20 is fit over this insertion shaft 27.

The shaft inclination mechanisms 61 are provided between a top end face 24*a* of the flange portion 24 formed on the outer circumference of the main shaft spindle 21 and a bottom end face 20*a* of the spindle holder 20. The shaft inclination mechanisms 61 are provided at for example three positions located at equal intervals in a circumferential direction of the flange portion 24.

Note that the top and end face 24*a* of the flange portion 24 is a surface parallel to the plane perpendicular to the axis K1 of the main shaft spindle 21 (polishing tool 8).

At the positions of the flange portion 24 of the main shaft spindle 21 where the shaft inclination mechanisms 61 are provided, through holes for inserting fixing bolts 65 are formed. In the bottom end face 20*a* of the spindle holder 20, screw holes for engaging with fixing bolts 65 are formed at positions corresponding to these through holes. The flange portion 24 of the main shaft spindle 21 and the bottom end face 20*a* of the spindle holder 20 are fixed by the fixing bolts 65 while sandwiching the shaft inclination mechanisms 61 therebetween.

Figure 8:
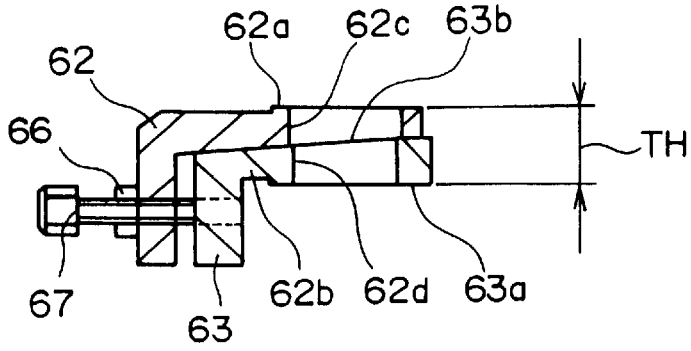
FIG. 8 is a sectional view of the structure of a shaft inclination mechanism.

Each shaft inclination mechanism 61 is provided with two inclination adjustment blocks 62 and 63 as shown in FIG. 8.

The inclination adjustment block 62 has an L-shaped cross section. One face 62*a* abutting against the bottom end face 20*a* of the spindle holder 20 serves as a reference face, while another face 62*b* opposite to this reference face 62*a* is an inclined face inclined with respect to the reference face 62*a*.

Figure 9A:
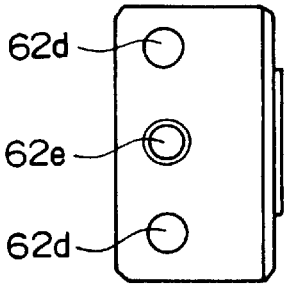
FIGS. 9A and 9B are views of the structure of an angle adjustment use block.
Figure 9B:
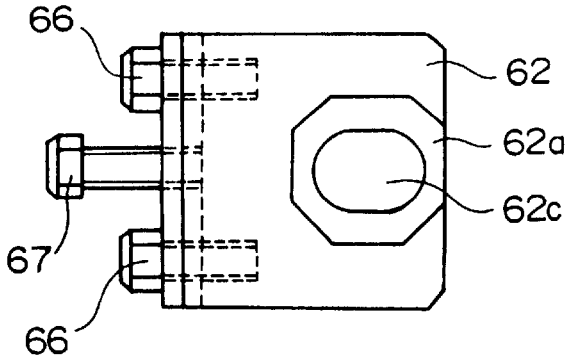

Also, as shown in FIGS. 9A and 9B, the reference face 62*a* of the inclination adjustment block 62 is formed with an insertion hole 62*c* for insertion of a fixing bolt 65.

Further, at the center portion on the side face of the inclination adjustment block 62 are formed a screw hole 62*e* for engaging with a bolt 67 and two through holes 66 for insertion of fixing bolts 66 positioned on the two sides of this screw hole 62*e*.

The inclination adjustment block 63 has an L-shaped cross section. The face of the main shaft spindle 21 abutting against the top end face 24*a* of the flange portion 24 serves as a reference face, while the face 63*b* opposite to this reference face 63*a* is an inclined face inclined with respect to the reference face 63*a*. This inclined face 63*b* abuts against the inclined face 62*b* of the inclination adjustment block 62 and is inclined with the same angle and opposite direction to the inclined face 62*b*.

Figure 10A:
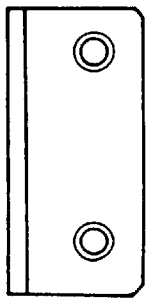
FIGS. 10A and 10B are views of the structure of another angle adjustment use block.
Figure 10B:
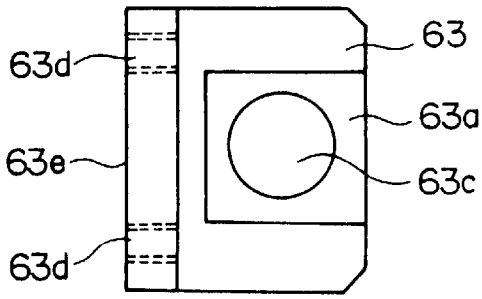

As shown in FIGS. 10A and 10B, the reference face 63*a* of the inclination adjustment block 63 is formed with an insertion hole 63*c* for insertion of the fixing bolt 65.

Further, at positions corresponding to the two through holes 66 of the inclination adjustment block 62 on the side face of the inclination adjustment use block 63 are formed two screw holes 63*d* for engaging with the fixing bolts 66.

In the state with the inclined face 62*b* of the inclination adjustment block 62 and the inclined face 63*b* of the inclination adjustment block 63 brought into contact, the reference face 62*a* of the inclination adjustment block 62 and the reference face 63*a* of the inclination adjustment block 63 are parallel. According to the relative positional relationship between the inclined face 62*b* of the inclination adjustment block 62 and the inclined face 63*b* of the inclination adjustment use block 63, the distance TH between the reference face 62*a* of the inclination adjustment block 62 and the reference face 63*a* of the inclination adjustment block 63 changes.

Accordingly, by adjusting the relative positions of the reference face 62*a* of the inclination adjustment block 62 and the reference face 63*a* of the inclination adjustment block 63, the distance TH can be adjusted and therefore the distance between the top end face 24*a* of the flange portion 24 of the main shaft spindle 21 and the bottom end face 20*a* of the spindle holder 20 can be adjusted.

Namely, by disposing the inclination adjustment blocks 62 and 63 at three positions between the top and end face 24*a* of the flange portion 24 of the main shaft spindle 21 and the bottom and face 20*a* of the spindle holder 20 and adjusting the distance TH between the reference faces 62*a* and 63*a*, the inclination angle of the axis K1 of the main shaft spindle 21 (polishing tool 8) with respect to the axis K2 perpendicular to the holding surface 41*a* of the rotation table 41 can be freely adjusted and the shaft can be inclined in any direction.

To adjust the inclination angle of the shaft K1 of the main shaft spindle 21 (polishing tool 8), first, the fixing bolts 65 for fixing the main shaft spindle 21 and the spindle holder 20 are loosened and the bolt 67 is turned in either direction. The tip of the bolt 67 then abuts against the side face 63*e* of the inclination adjustment block 63, whereby the relative positions between the inclination adjustment blocks 62 and 63 can be determined, and the distance TH between the reference faces 62*a* and 63*a* of the inclination adjustment blocks 62 and 63 can be changed in accordance with these relative positions. By appropriately adjusting the distance TH between the reference faces 62*a* and 63*a* of the inclination adjustment blocks 62 and 63, the inclination direction and the inclination amount of the shaft K1 of the main shaft spindle 21 (polishing tool 8) are adjusted.

When the distance TH between the reference faces 62*a* and 63*a* of the inclination adjustment blocks 62 and 63 is adjusted to an intended value, the fixing bolts 66 are tightened, the relative positions between the inclination adjustment blocks 62 and 63 are fixed, and further the fixing bolts 65 are tightened, whereby the adjustment of the inclination direction and the inclination amount of the shaft K1 of the main shaft spindle 21 (polishing tool 8) is completed.

Next, an explanation will be made of the polishing method of the present invention using the polishing apparatus 1 of the above configuration.

Inclination of Shaft (Angle $\alpha$)

First, the shaft inclination mechanism 61 of the polishing apparatus 1 is adjusted and the shaft K1 of the polishing tool 8 is inclined by the predetermined angle with respect to the direction perpendicular to the plane parallel to the holding surface 41*a* of the rotation table 41 toward the direction of advance of the movement of the polishing tool 8.

Figure 11:
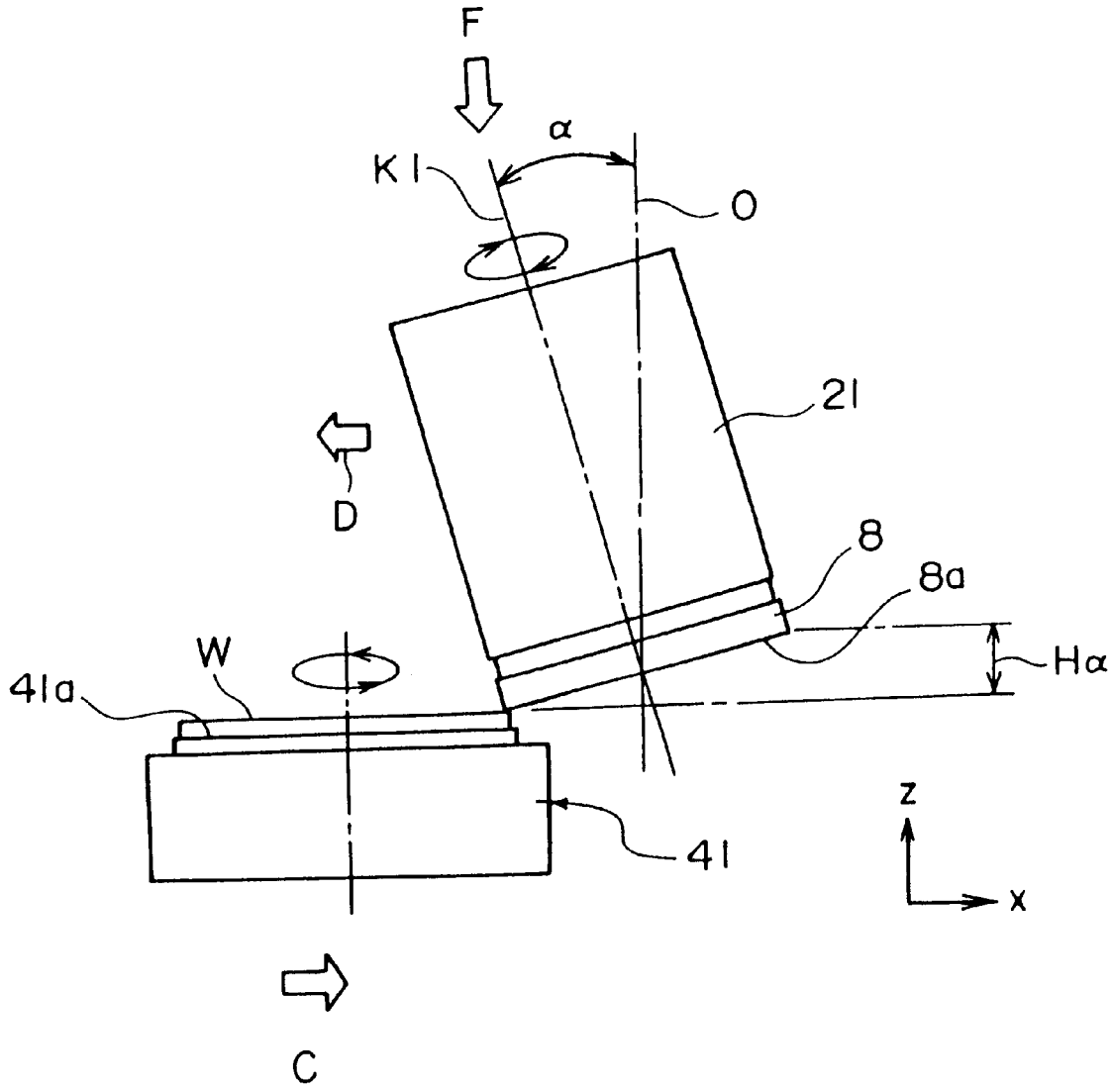
FIG. 11 is a view for explaining a polishing method of the present invention and shows an inclination of a shaft of a polishing tool in a direction of advance.

Specifically, as shown in FIG. 11, the shaft K1 of the polishing tool 8 is inclined by an angle $\beta$ with respect to the wafer W of the polishing tool 8 toward a relative direction of advance D (direction wherein the polishing is advanced) with respect to an axis O perpendicular to a plane (X-Y plane) parallel to the holding surface 41*a* of the rotation table 41.

The inclination angle $\beta$ of the shaft K1 of the polishing tool 8 is set to for example a value where the height difference H of the front and rear ends in the Z-axial direction concerning the X-axial direction of the polishing surface 8*a* of the polishing tool 8 shown in FIG. 11 is about 15 to 50 $\beta$m. Namely, the inclination length is about 15 to 50 $\beta$m with respect to a length of 8 inches.

Inclination of Shaft (Angle $\beta$)

Further, the shaft K1 of the polishing tool 8 is inclined in a direction reducing the elastic deformation of the polishing surface 8*a* in the region where the polishing surface 8*a* rides up on the outer circumferential edge of the surface to be polished of the wafer W with respect to a direction perpendicular to the holding surface 41*a* of the rotation table.

Figure 12A:
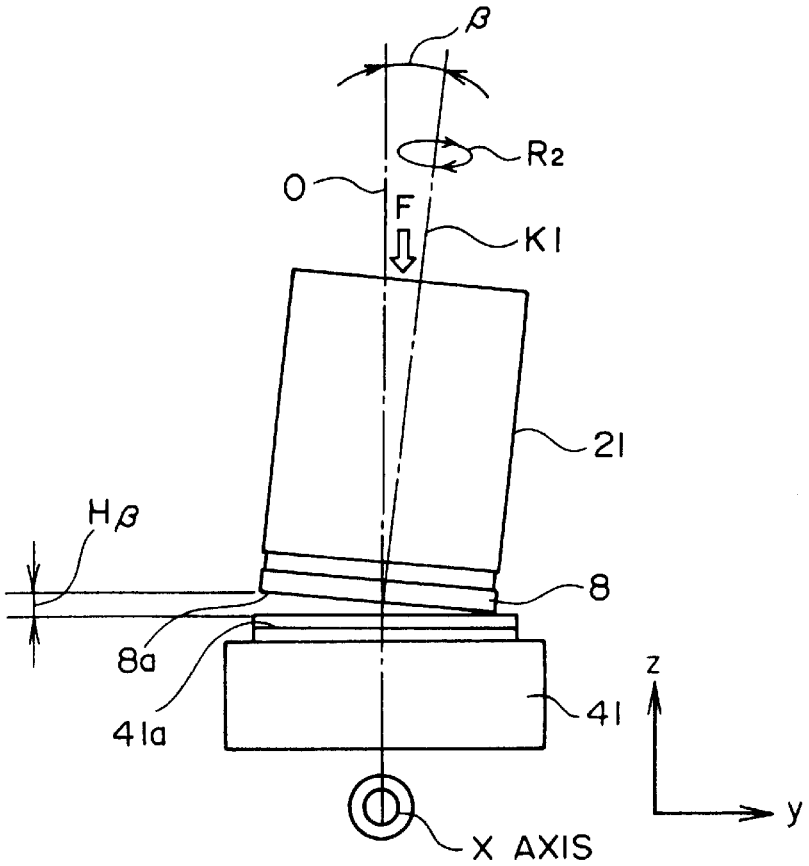
FIGS. 12A and 12B are views for explaining a polishing method of the present invention and shows the inclination of the shaft of the polishing tool in a direction reducing an elastic deformation of a polishing surface in a riding region.

This inclination in the direction reducing the elastic deformation is not limited to one direction, but preferably, as shown in FIG. 12A, the shaft K1 of the polishing tool 8 is inclined at an angle $\beta$ from the axis O along a plane (Y-Z plane) perpendicular to the relative direction of advance D of the polishing tool 8 with respect to the wafer W. Note that, FIG. 12A shows the relationship between the polishing tool 8 and the wafer W seen from the direction of advance D of the polishing tool 8, while FIG. 12B shows the relationship between the polishing tool 8 and the wafer W seen from the Z-axial direction.

Figure 12B:
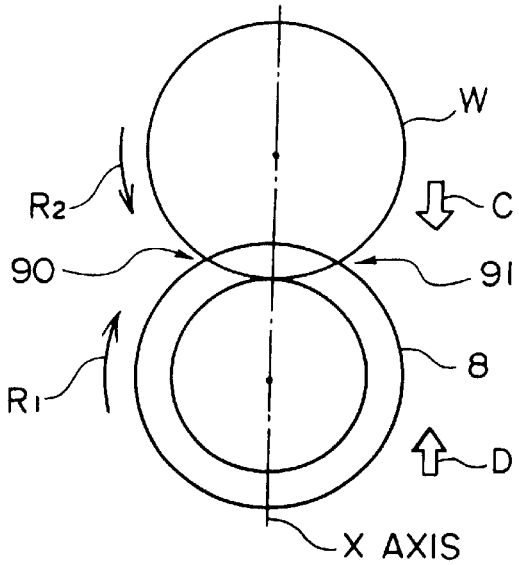

The direction of the inclination of the shaft K1 of the polishing tool 8 is a direction where the height of the polishing surface 8*a* of the polishing tool 8 with respect to the wafer W in the riding region 90 becomes higher than that in the away region 91 in the region 90 of the polishing tool 8 riding up on the outer circumferential edge of the wafer W shown in FIG. 12B and the region 91 away of the polishing tool 8 from the outer circumferential edge of the wafer W.

The inclination angle β of the shaft K1 of the polishing tool 8 is set to a value whereby a height difference Hβ of the front and rear edges of the polishing surface 8*a* of the polishing tool 8 in the Z-axial direction shown in FIG. 12A concerning a Y-axial direction becomes for example about 15 to 30 βm. Namely, the inclination angle is about 15 to 30 βm with respect to a length of 8 inches. Further, as will be mentioned later, preferably the inclination angle β of the shaft K1 of the polishing tool 8 is set to a larger value than the inclination angle β.

Next, in the polishing apparatus 1 in the state where the shaft K1 is inclined by the inclination angles β and β in two different directions, the state where the back surface of the wafer W is fixed onto the holding surface 41*a* of the rotation table 41 and where the rotation table 41 and the polishing tool 8 are rotated is exhibited.

Figure 13:
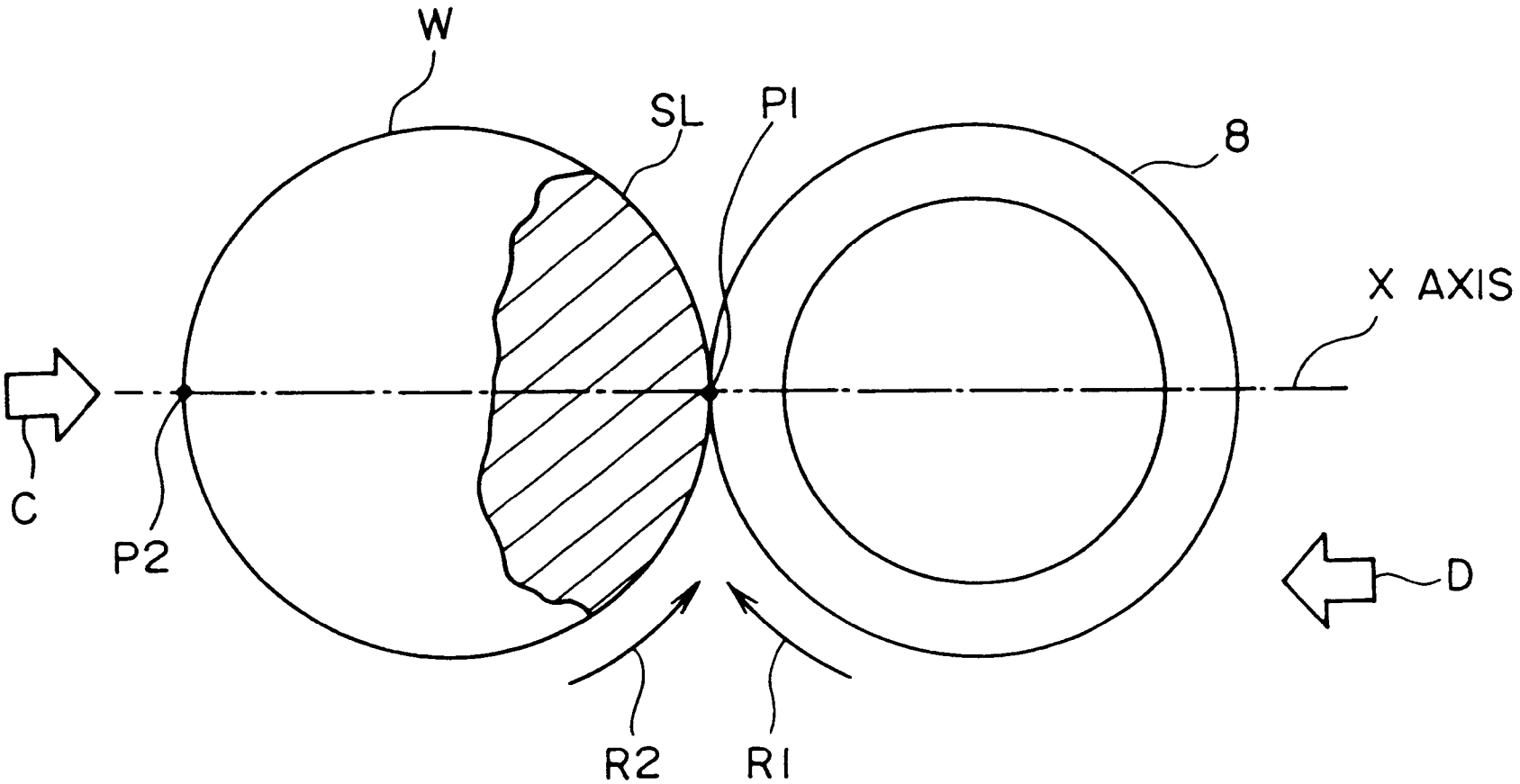
FIG. 13 is a view explaining a polishing method of the present invention and shows a relative positional relationship between a wafer W and a polishing tool.

As shown in FIG. 13, the rotation direction R1 of the polishing tool 8 and the rotation direction R2 of the wafer W are set reverse to each other.

Further, as shown in FIG. 13, a constant amount of slurry SL is discharged onto the wafer W from the slurry/pure water feed nozzle 81. Note that the slurry SL is constantly supplemented in exactly the required amount at the time of polishing as well. The slurry is not particularly limited, but use can be made of for example one obtained by suspending a silica-based fumed silica and high purity ceria in an aqueous solution containing potassium hydroxide as a base for an oxide film or one obtained by mixing a solvent having an oxidizing power into a polishing liquid containing alumina as the polishing abrasive for an interconnection metal.

Next, the polishing tool 8 is moved downward in the Z-axial direction. As shown in FIG. 13, a state is exhibited where the outer circumferential edge of the polishing surface Ba of the polishing tool 8 located outside of the wafer W is located at the outer circumferential edge and where a polishing start point P1 of the outer circumferential edge of the wafer W and the outer circumferential edge of the polishing tool 8 are overlapped. Note that, in this state, the centers of rotation of the polishing tool 8 and the wafer W are located on the same line along the X-axis.

Next, the polishing tool 8 is pressed against the wafer W, and the wafer W and the polishing surface of the polishing tool 8 are brought into contact while rotating while applying the polishing pressure F in a direction perpendicular to the surface to be polished of the wafer W.

From this state, the X-axis table 52 is driven to move the wafer W from the polishing start point P1 with the predetermined speed pattern in the direction of the arrow C showing the relative increase of the overlapping area of the wafer W and the polishing tool 8. Due to this, the polishing tool 8 is relatively advanced toward a radial direction of the wafer W.

Note that, at the time of start of the polishing, when moving the polishing tool 8 relatively with respect to the wafer W after the polishing surface 8*a* of the polishing tool 8 is brought into contact with the polishing start point P1 of the wafer W, the polishing pressure F is gradually increased corresponding to the relative movement of the polishing tool B. When the polishing tool 8 reaches a predetermined position with respect to the wafer W, the polishing is performed while keeping the polishing pressure F a constant value.

The area of the crescentic region mentioned later becomes gradually larger from the polishing start point P1 along with the increase of the polishing pressure F. After the polishing tool 8 reaches a predetermined position with respect to the wafer W, the area of this crescentic region becomes an approximately constant area. Due to this, uniformity of the amount of polishing by the polishing tool 8 is obtained. Further, the speed pattern of the polishing tool 8 in the X-axial direction is adjusted in advance so that the amount of polishing in the wafer W surface becomes uniform.

Figure 14B:
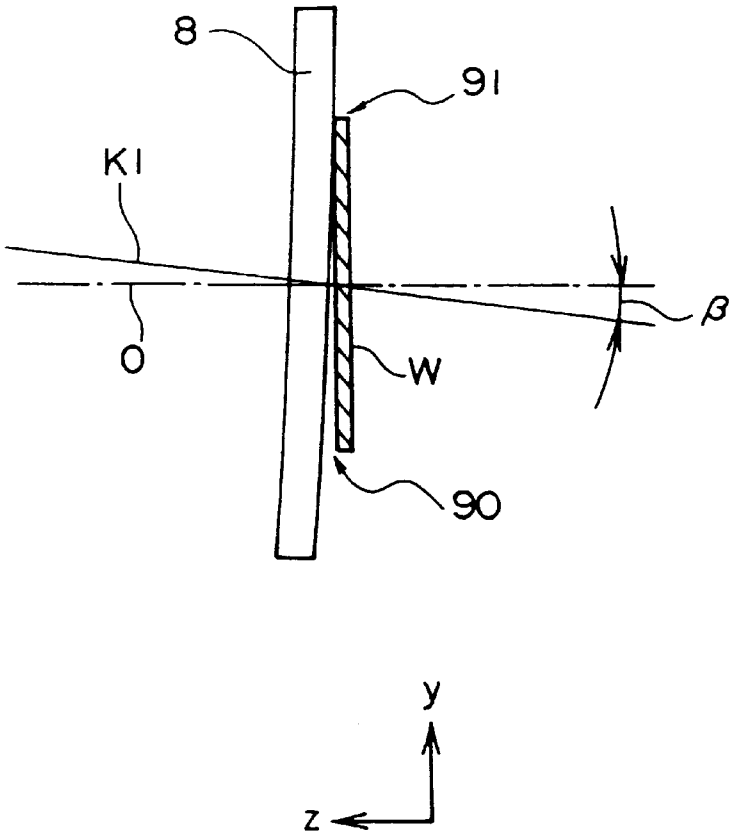
FIG. 14B is a sectional view along a line A—A line of FIG. 14A.
Figure 14A:
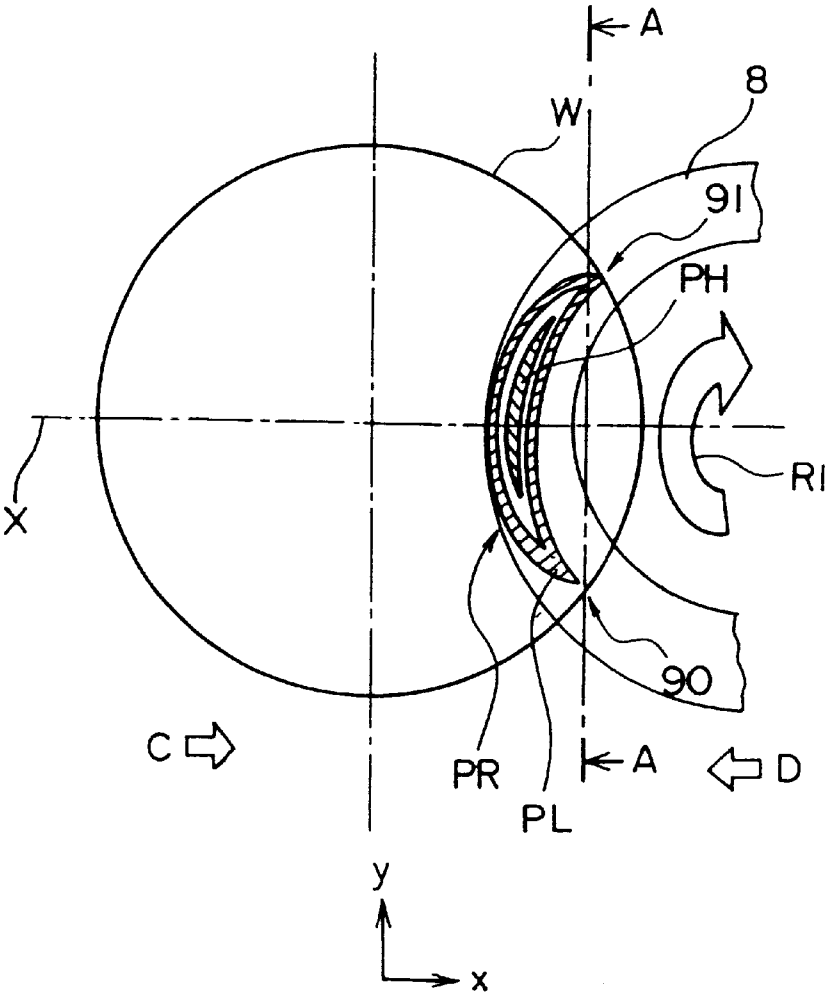
FIG. 14A is a view of an example of a distribution of pressure generated between a polishing surface of the polishing tool and a surface to be polished of the wafer.

FIG. 14A is a view of an example of the distribution of the pressure generated between the polishing surface 8*a* of the polishing tool 8 and the surface to be polished of the wafer W, while FIG. 14B is a sectional view along a line A—A of FIG. 14A. Note that, FIG. 14A shows the distribution of the virtual pressure when polishing by the polishing tool 8 without rotating the wafer W.

The shaft K1 of the polishing tool 8 is inclined by an angle β toward the relative direction of advance D of the polishing tool 8 relative to the wafer W with respect to the axis O as explained in FIG. 11. For this reason, as shown in FIG. 14A, the distribution of the pressure generated between the polishing surface 8*a* of the polishing tool 8 and the surface to be polished of the wafer W basically becomes an approximate crescentic region PR.

In this crescentic region PR, an area PH where the pressure is relatively high is generated inside and an area PL where the pressure existing around this is relatively low is generated. The area PH where the pressure is relatively high becomes a region effectively acting upon the surface to be polished of the wafer W. The area PH is made sufficiently smaller than the overlapping area of the wafer W and the polishing surface 8*a* of the polishing tool 8. Even if the polishing tool 8 moves relatively in the direction of advance D, the area of the area PH becomes approximately constant. For this reason, the amount of polishing in the effective working region can be made uniform, and the polishing rate can be made constant.

On the other hand, as shown in FIG. 14B, the shaft K1 of the polishing tool 8 is inclined by the angle β in a direction where the height of the polishing surface 8*a* of the polishing tool 8 with respect to the wafer W surface in the region 90 of the polishing tool 8 riding up on the outer circumferential edge of the wafer W becomes higher than the height of the polishing surface 8*a* with respect to the surface of the wafer W in the region 91 away of the polishing tool 8 from the outer circumferential edge of the wafer W.

For this reason, the elastic deformation of the polishing surface 8*a* of the polishing tool 8 in the riding region 90 is reduced, and the damage occurring in the outer circumferential edge of the wafer W can be suppressed.

Figure 15A:
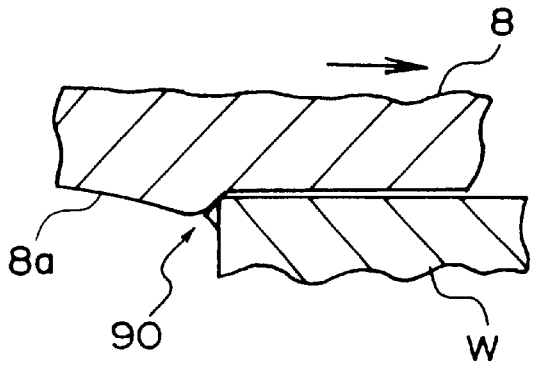
Figure 15B:
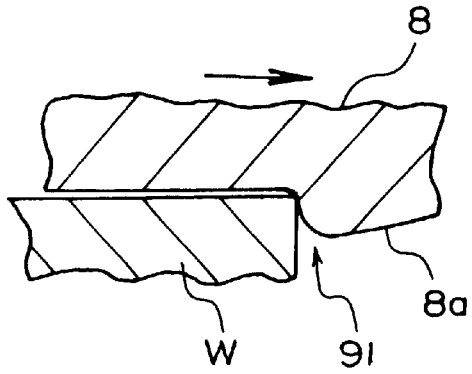

Here, the states of the polishing surface 8*a* of the polishing tool 8 in the riding region 90 and the relief region 91 are shown in FIGS. 15A and 15B.

FIGS. 15A and 15B are views of the states of the polishing surface 8*a* of the polishing tool 8, wherein FIG. 15A shows the state in the riding region 90 and FIG. 15B shows the state in the relief region 91. Note that, FIG. 15A and FIG. 15B are sectional views in the regions 90 and 91 along the radial direction of the wafer W.

When the inclination angle β is relatively small, as shown in FIGS. 15A and 15B, elastic deformation of the polishing surface 8*a* of the polishing tool 8 in the riding region 90 occurs, but the amount of elastic deformation becomes relatively smaller than the amount of elastic deformation in the away region 91. For this reason, in the riding region 90 of the polishing surface 8*a* of the polishing tool 8, the contact pressure of the resiliently deformed polishing surface 8*a* of the polishing tool 8 with respect to the outer circumferential edge of the wafer W is reduced from the case where the shaft K1 is not inclined and the excessive polishing occurring in the outer circumferential edge of the wafer W can be suppressed.

The working energy no longer consumed due to the reduction of the elastic deformation of the polishing surface 8*a* of the polishing tool 8 in the riding region 90 is concentrated to the area PH where the pressure effectively acting on the surface to be polished of the wafer W is relatively high and therefore the polishing rate is improved.

Because of the reduction of the contact pressure of the resiliently deformed polishing surface 8*a* of the polishing tool 8 with respect to the outer circumferential edge of the wafer W, the slurry SL deposited on the rotating polishing surface 8*a* of the polishing tool 8 easily penetrates into the space between the polishing surface 8*a* of the polishing tool 8 and the surface of the outer circumferential edge of the wafer W in the riding region 90. For this reason, the slurry is stably and practically fed to the effective working region between the polishing surface 8*a* and the surface to be polished of the wafer W and therefore the polishing rate is improved and stabilized.

On the other hand, in the relief region 91 of the polishing surface 8*a* of the polishing tool 8, it is considered that the polishing pressure is increased and the amount of elastic deformation is increased in accordance with the reduction of the elastic deformation of the polishing surface 8*a* in the riding region 90. When the amount of elastic deformation of the polishing surface 8*a* increases in the relief region 91, the effect with respect to the outer circumferential edge of the wafer W increases, but the resiliently deformed polishing surface 8*a* will not wrap around the outer circumferential edge of the wafer W in the relief region 91, and the effect thereof is sufficiently small compared with the effect in the riding region 90.

Figure 16A:
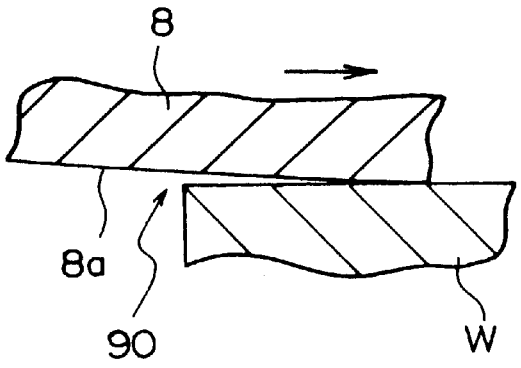
FIGS. 16A and 16B are views of the state of the polishing surface of the polishing tool where an inclination angle $\beta$ is made relatively larger than the case shown in FIGS. 15A and 15B.
Figure 16B:
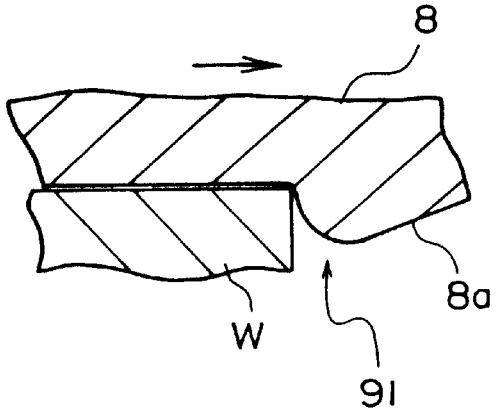

FIGS. 16A and 16B show the states where the inclination angle β is made relatively larger than the case shown in FIGS. 15A and 15B.

When increasing the inclination angle β, as shown in FIG. 16A, the state can be exhibited where the occurrence of elastic deformation of the polishing surface 8*a* of the polishing tool 8 is completely eliminated in the riding region 90 and a clearance is formed between the polishing surface 8*a* and the wafer W surface.

When exhibiting such a state, almost no working energy is now consumed in the riding region 90, the working energy is concentrated at the area PH where the pressure effectively acting upon the surface to be polished of the wafer W is relatively high, and thus the polishing rate can be further improved. Further, since a clearance is formed between the polishing surface 8*a* and the wafer W surface, the slurry SL more easily penetrates between the polishing surface 8*a* and the surface to be polished of the wafer W, thus the slurry SL can be further stably and efficiently fed to the effective working region.

When increasing the inclination angle β, as shown in FIG. 16B, it can be considered that the amount of elastic deformation of the polishing surface 8*a* in the relief region 91 increases. As described above, in the relief region 91, the resiliently deformed polishing surface 8*a* is not wrapped around the outer circumferential edge of the wafer W, so the effect is relatively small, but when the influence of the elastic deformation of the polishing surface 8*a* in the relief region 91 is not negligible, for example, the polishing pressure F of the polishing tool 8 with respect to the wafer W is adjusted (made small), and the amount of elastic deformation of the polishing surface 8*a* in the relief region 91 is made small. Due to this, the effect of the elastic deformation of the polishing surface Ba in the relief region 91 can, be reduced. Even if the polishing pressure F is reduced, the working energy is concentrated to the area PH, so the reduction of the polishing rate can be minimized.

As shown in FIG. 14A, when the shaft K1 is inclined by the angle β, the entire crescentic region PR shifts toward the region 91 away of the polishing surface 8*a* from the outer circumferential edge of the wafer W in accordance by the inclination of the angle β. Also the effective working region, that is, the area PH where the pressure is high, shifts toward the region 91 away of the polishing surface 8*a* from the outer circumferential edge of the wafer W. For this reason, the effective working area, that is, the area PH where the pressure is high, no longer has the symmetric shape about the X-axis passing through the center of the wafer W. The larger the angle β, the further from the X-axis passing through the center of the wafer W.

Accordingly, if the inclination angle β of the shaft K1 of the polishing tool 8 is set too large, the effective working area, that is, the area PH having the high pressure, completely separates from the X-axis passing through the center of rotation of the wafer W. Therefore, when the polishing tool 8 and the wafer W are both rotated and the wafer W is polished, the center region of the wafer W can no longer be sufficiently polished.

In order to prevent this, preferably the inclination angle β of the shaft K1 of the polishing tool 8 is set up smaller than the inclination angle , and further preferably the inclination angle β is set up so that the area PH having the high pressure as the effective working area intersects with the X axis passing through the rotation center of the wafer W.

As mentioned above, the polishing by the polishing tool 8 is carried out along the direction of advance D while suppressing the excessive polishing of the outer circumferential edge of the wafer W, and the outer circumferential edge of the polishing tool 8 reaches a polishing end point P2 of the wafer W shown in FIG. 8.

When the outer circumferential edge of the polishing tool 8 moves up to the polishing end point P2 of the wafer W, the polishing of the surface to be polished of the wafer W is terminated. The polishing is ended by moving the polishing tool 8 upward in the Z-axial direction.

By ending the polishing at a position where the outer circumferential edge of the wafer W and the polishing tool 8 schematically overlap in this way, there is almost no damage to the outer circumferential edge of the wafer W.

Further, even if the polishing is ended at a position where the outer circumferential edge of the polishing tool 8 slightly projects from the polishing end point P2, the outer diameter of the polishing tool 8 and the diameter of the wafer W are approximately equal, therefore there is almost no speed component of the polishing surface 8*a* of the polishing tool 8 going toward the center of the wafer W, so there is almost no damage to the outer circumferential edge of the wafer W occurred due to the riding of the polishing surface 8*a*.

As described above, according to the polishing method according to the present embodiment, by inclining the shaft K1 of the polishing tool 8 in a direction reducing the elastic deformation generated in the rotating polishing surface 8*a* of the polishing tool 8 in the region 90 riding up on the outer circumferential edge of the wafer W, the elastic deformation of the polishing surface 8*a* of the polishing tool 8 is eased and the polishing pressure of the effective working region, that is, the area PH having the high pressure, between the wafer W and the polishing surface 8*a* increases by that amount.

Due to this, the working energy is concentrated at the effective working region between the wafer W and the polishing surface 8*a*, and the polishing efficiency is improved.

Further, according to the present embodiment, the height of the polishing surface Ba of the polishing tool 8 in the region 90 riding up on the outer circumferential edge of the wafer W becomes relatively high, therefore a clearance is formed between them, so the slurry easily penetrates between the polishing surface 8*a* and the surface to be polished of the wafer W. Namely, the slurry deposited on the rotating polishing surface 8*a* is conveyed to the space between the polishing surface 8*a* and the surface to be polished of the wafer W.

As a result, the slurry is stably and efficiently fed to the effective working region between the polishing surface 8*a* and the surface to be polished of the wafer W, so the polishing rate is improved and stabilized.

Further, in the present embodiment, the consumption of the working energy due to riding up on the outer circumferential edge of the wafer W can be suppressed, therefore when partially polishing the surface to be polished of the wafer W by part of the polishing surface 8*a* of the polishing tool 8, that is, the area PH having the high pressure of the crescentic region PR described above, the working energy is concentrated to the narrowed effective working area, that is, the area PH, therefore the ability of the area PH to follow warping or undulation of the wafer W surface is improved.

Namely, distortion or the like occurring up to the previous step exerts an influence upon the shape of the wafer W, so there is sometimes warping or undulation of several $\mu$m to 10 $\mu$m in the surface to be polished of the wafer W, but if the polishing surface 8*a* of the polishing tool 8 strongly presses the outer circumferential edge of the wafer W, the followability of the effective working region, that is, the area PH having the high pressure of the crescentic region PR for polishing to warping or undulation is lowered, but in the present invention, this reduction of the followability can be prevented, and the polishing uniformity can be improved.

According to the present embodiment, the elastic deformation of the polishing surface 8*a* in the region 90 of the polishing surface 8*a* of the polishing tool 8 riding up on the outer circumferential edge of the wafer W is reduced, therefore the deterioration of the quality of the polishing surface 8*a* of the polishing tool 8 is small, and the frequency of the conditioning of,the polishing surface 8*a* can be suppressed.

Note that, as described above, when the center region of the wafer W cannot be sufficiently polished due to the effective working region, that is, the area PH having the high pressure of the crescentic region PR, being separated from the line in the X-axial direction passing through the center of the wafer W due to the inclination of the shaft K1 with the large inclination angle β, for example, it is possible to make the effective working region, that is, the area PH having the high pressure of the crescentic region PR, pass above the center of rotation of the wafer W by moving the rotation table 41 in the X-axis and the Y-axis by holding the rotation table 41 on the X-Y table for moveably holding the rotation table 41 in the X-axial and Y-axial directions in place of the X-axis table 52 for holding the rotation table 41.

Second Embodiment

Next, an explanation will be made of another polishing method using the polishing apparatus 1 as a second embodiment of the present invention.

Figure 17A:
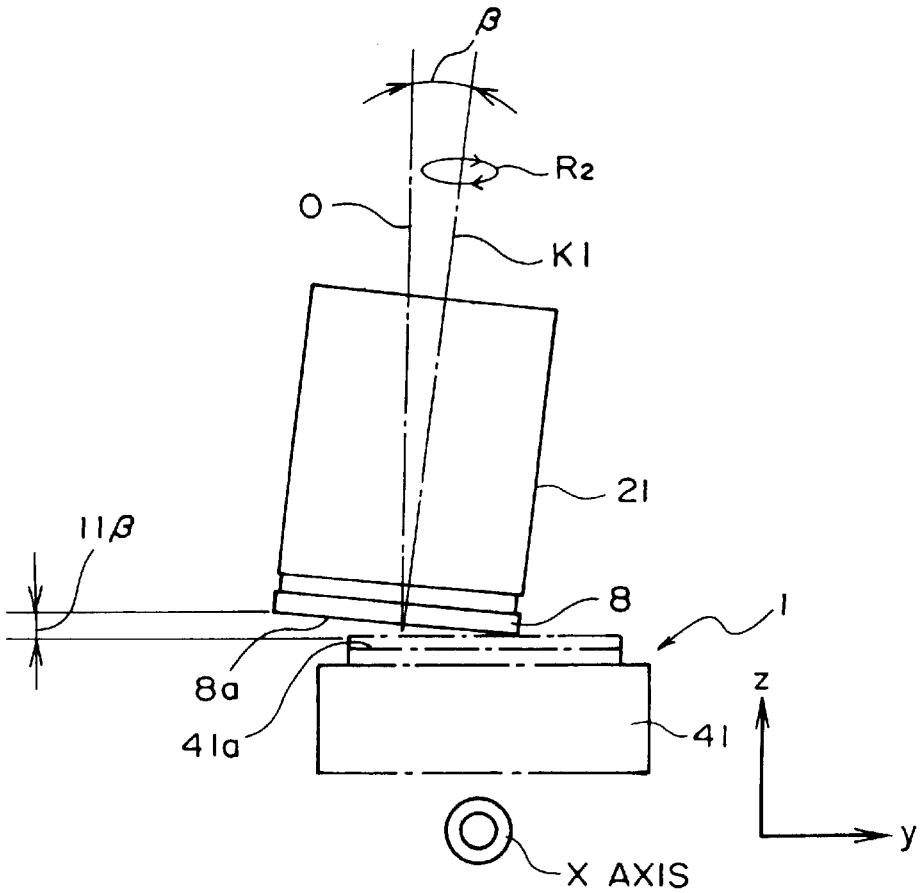
FIGS. 17A and 17B are views for explaining a polishing method according to a second embodiment of the present invention.
Figure 17B:
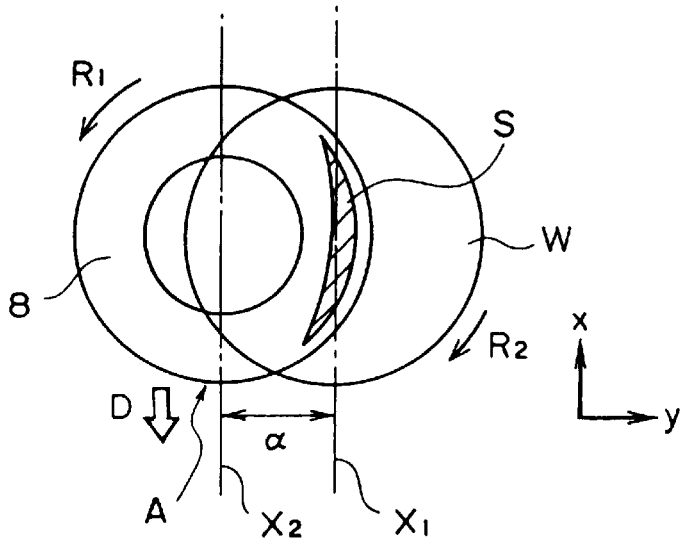

FIGS. 17A and 17B are views for explaining the polishing method according to the second embodiment of the present invention, wherein FIG. 12A is a view of the state of inclination of the polishing tool 8 in the polishing apparatus 1, and FIG. 12B is a view of the positional relationship of the wafer W and the polishing tool 8 in a direction of relative movement.

In the present embodiment, the polishing tool 8 and the wafer W are relatively moved with the positional relationship shown in FIG. 17B. Namely, the polishing tool 8 is moved in the direction of the direction of advance D along a line X2 parallel to a line X1 passing through the center of rotation of the wafer W along the X-axial direction separate from the line X1 by a predetermined distance d.

As shown in FIG. 17A, the shaft K1 of the polishing tool 8 is inclined by the angle β from the axis O perpendicular to the holding surface 41*a* of the rotation table 41 along the Y-Z plane perpendicular to the relative direction of advance D of the polishing tool 8 with respect to the wafer W. The shaft K1 of the polishing tool 8 is inclined by the angle β along the Y-Z plane with respect to the axis O perpendicular to the holding surface 41*a* of the rotation table 41.

The direction of inclination of the angle β is a direction where the height of the polishing surface 8*a* of the polishing tool 8 located on a line passing through the center of the wafer W with respect to the wafer W becomes relatively low as shown in FIG. 12A.

The inclination angle β of the shaft K1 of the polishing tool 8 is set to a value where the height difference Hβ of the front and rear ends of the polishing surface 8*a* of the polishing tool 8 shown in FIG. 17A in the Z-axial direction with respect to the Y-axial direction becomes for example about 15 to 30 βm. Namely, the inclination angle is about 15 to 30 βm with respect to a length of 8 inches.

When the shaft K1 of the polishing tool 8 is inclined with the angle $\mu$, the effective working region S of the polishing surface 8*a* of the polishing tool 8 with respect to the wafer W becomes crescentic as shown in for example FIG. 17B.

The distance d between the lines X1 and X2 is set to a distance where the effective working region S of the polishing surface 8*a* shown in FIG. 17B is located on the line X1 passing through the center of the wafer W.

The rotation direction R1 of the polishing tool 8 and the rotation direction R2 of the wafer W are made reverse to each other as shown in FIG. 17B.

Figure 18A:
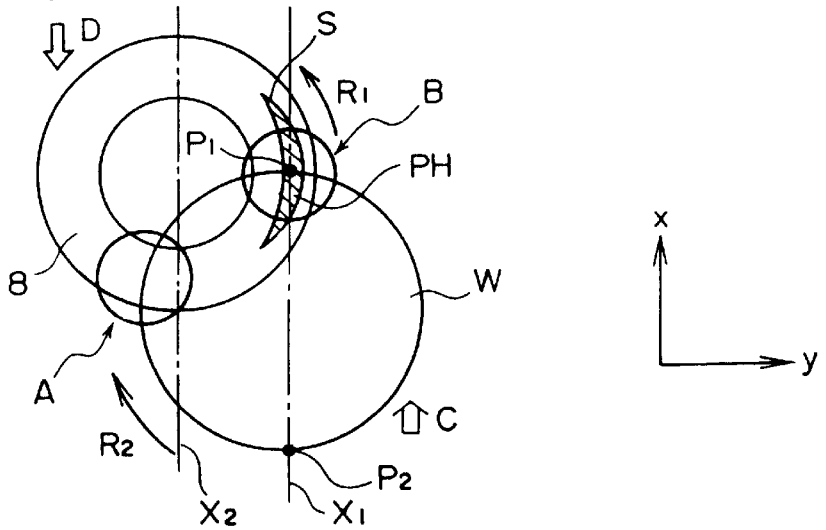
FIGS. 18A to 18C are views for explaining the polishing routine of the polishing method according to the second embodiment of the present invention.
Figure 18B:
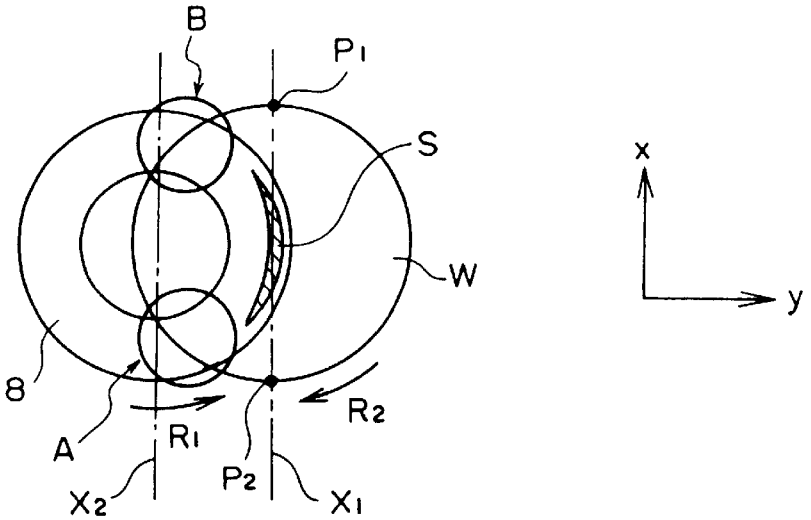
Figure 18C:
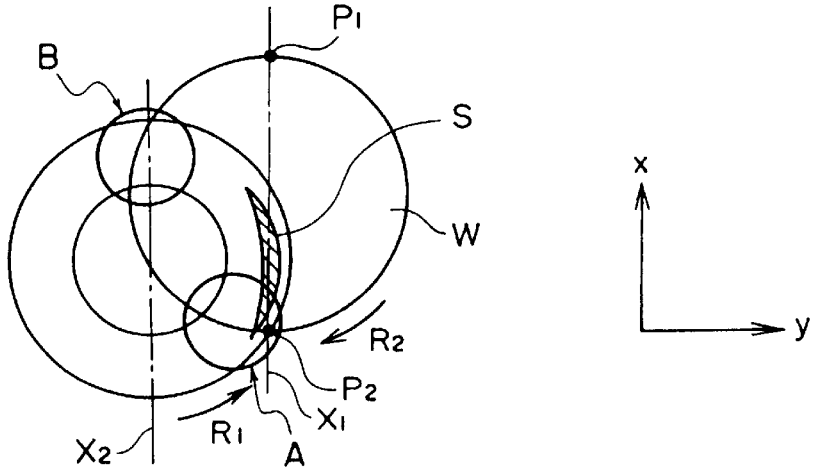

FIGS. 18A to 18C are views for explaining the polishing routine of the polishing method according to the present embodiment.

The polishing of the wafer W is started from for example the polishing start position P1 shown in FIG. 18A.

Namely, the polishing tool 8 is pressed against the wafer W so that the effective working region S of the polishing surface 8*a* of the polishing tool 8 is located at the polishing start position P1 of the wafer W.

At this time, the region indicated by the circle A becomes the riding region where the polishing surface 8*a* of the polishing tool 8 rides up on the outer circumferential edge of the wafer W, while the region indicated by the circle B becomes the relief region of relief of the polishing surface 8*a* of the polishing tool 8 from the outer circumferential edge of the wafer W.

In this riding region, the shaft K1 of the polishing tool 8 is inclined by the angle β, therefore the elastic deformation of the polishing surface 8*a* is reduced, and the damage to the outer circumferential edge of the wafer W is suppressed.

When moving the polishing tool 8 from the position shown in FIG. 18A in the relative direction of advance D, the effective working region S moves along the radial direction of the rotating wafer W. For this reason, as shown in FIG.

18B, the effective working region S passes the center of rotation of the wafer W, so insufficient polishing does not occur at the center portion of the wafer W.

Along with the movement of the polishing tool 8 in the relative direction of advance D, the riding region indicated by the circle A approaches the line X1. For this reason, the distance between the polishing surface 8*a* and the surface to be polished of the wafer W in the riding region closes and elastic deformation of the polishing surface 8*a* in the riding region occurs. Alternatively, the elastic deformation which had been reduced increases.

For this reason, as shown in FIG. 18C, the polishing is terminated around the position where the tip of the effective working region S in the direction of advance D reaches the polishing end position P2 of the outer circumferential edge of the wafer W.

Due to this, the excessive polishing of the outer circumferential edge of the wafer W due to the riding up of the polishing surface 8*a* can be prevented.

As described above, according to the present embodiment, by suitably selecting the arrangement and direction of relative movement of the wafer W and the polishing tool, even when the shaft K1 is inclined in only one direction, the excessive polishing of the outer circumferential edge of the wafer W can be prevented and, at the same time, the occurrence of insufficient polishing at the center portion of the wafer W can be avoided.

Third Embodiment

Next, an explanation will be made of still another polishing method using the polishing apparatus according to a third embodiment of the present invention.

In the first embodiment explained above, the polishing was carried out by inclining the shaft K1 of the polishing tool 8 by the inclination angle β toward the direction of advance of the polishing tool 8 with respect to the direction perpendicular to a plane parallel to the holding surface 41*a* of the rotation table 41 and then inclining the shaft K1 of the polishing tool 8 by the inclination angle β in the direction reducing the elastic deformation of the polishing surface 8*a* in the region where the polishing surface 8*a* rides up on the outer circumferential edge of the surface to be polished of the wafer W with respect to the direction perpendicular to the holding surface 41*a* of the rotation table 41.

In the present embodiment, in the same way as the first embodiment, the polishing is carried out by inclination in different two directions by the inclination angles α and β, but further use is made of the polishing tool 8 having the polishing surface 8*a* faced along the correction surface of the correction tool parallel to the holding surface 41*a* of the holding table 41.

Figure 19A:
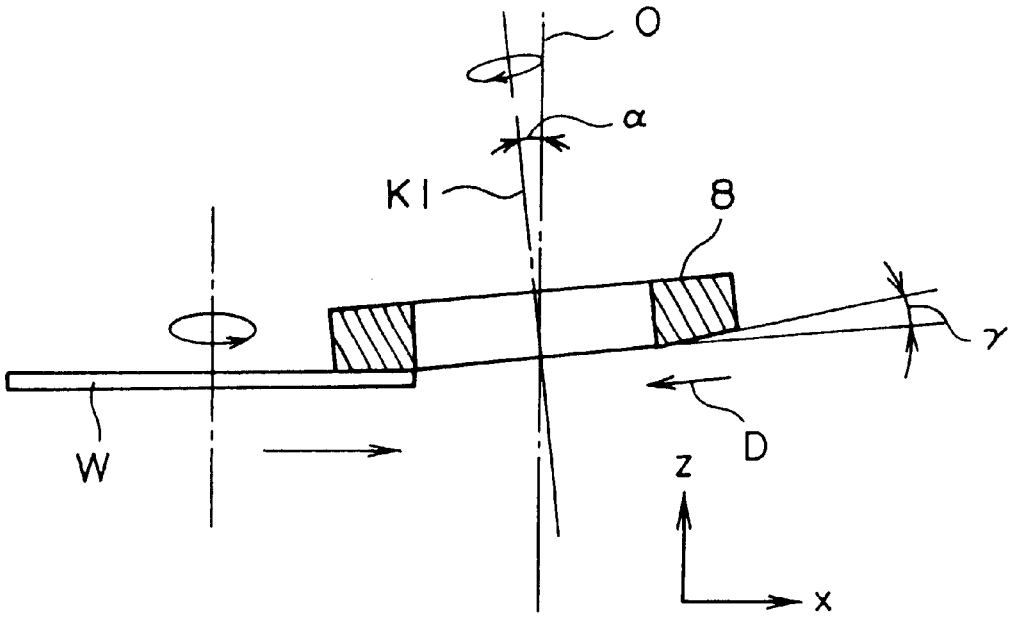
FIGS. 19A and 19B are views for explaining a polishing method according to a third embodiment of the present invention.
Figure 19B:
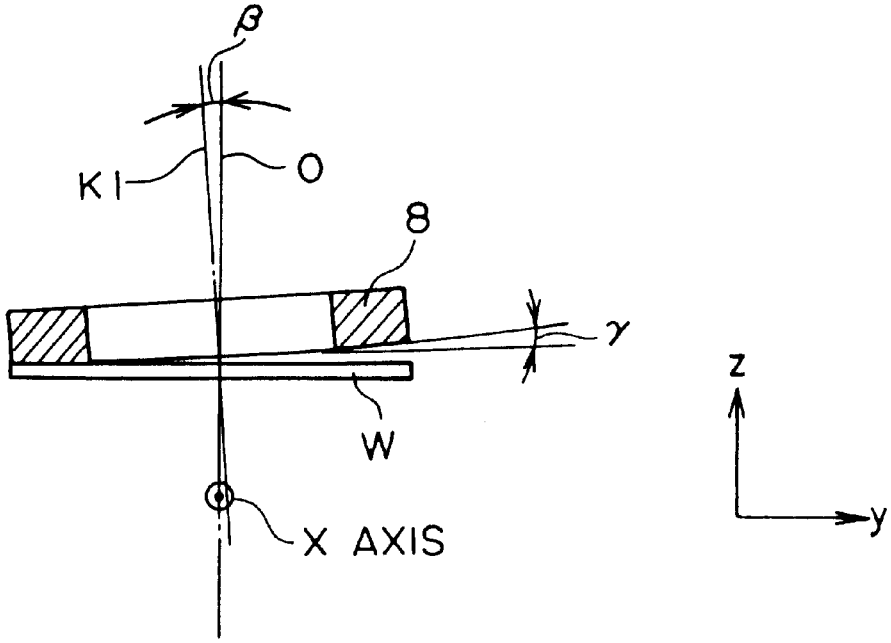

Specifically, as shown in FIG. 19A and FIG. 19B, the shaft K1 of the polishing tool 8 is inclined by the inclination angle β toward the direction of advance D of the polishing tool with respect to the axis O perpendicular to a plane parallel to the holding surface 41*a* of the holding table 41 and then inclined by the inclination angle β along a plane perpendicular to the direction of advance D with respect to the axis O.

Further, the polishing surface 8*a* of the polishing tool 8 is inclined by an angle γ combining the angle a and the angle β.

Figure 20A:
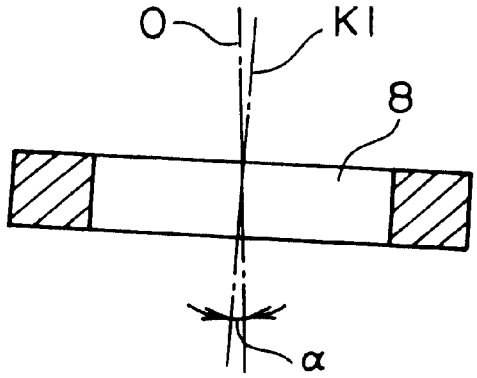
FIGS. 20A to 20C are views for explaining a method of facing the polishing surface of the polishing tool.

In the method of formation of the polishing surface 8*a* of the polishing tool 8 described above, for example, as shown in FIG. 20A, the polishing tool 8 is rotated in a state where the shaft K1 of the polishing tool 8 is inclined by the angle β toward the direction of advance D of the polishing tool 8, and further, although not illustrated, the shaft K1 of the polishing tool 8 is inclined by the inclination angle β along the plane perpendicular to the direction of advance D with respect to the axis O.

Figure 20B:
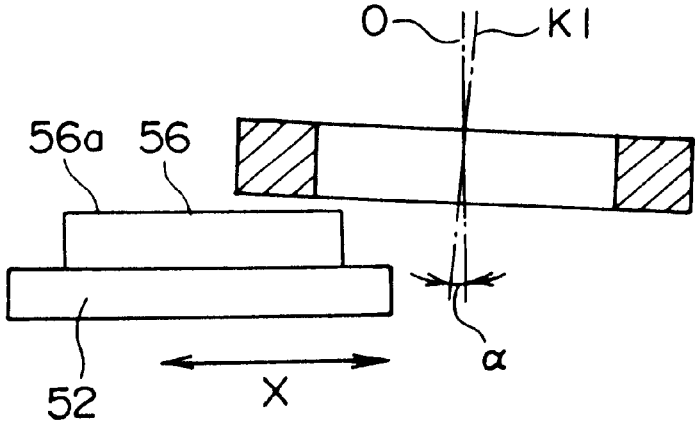

Further, as shown in FIG. 20B, a correction tool 56 is disposed on the X-axis table 52. The correction tool 56 has a correction surface 56*a* perpendicular with respect to the axis O, that is, perpendicular to the uninclined shaft K1. This correction surface 56*a* is a plane parallel to the holding surface 41*a* of the holding table 41 for holding the wafer W. To this correction surface 56*a* is affixed a polishing abrasive, for example, a diamond abrasive.

Figure 20C:
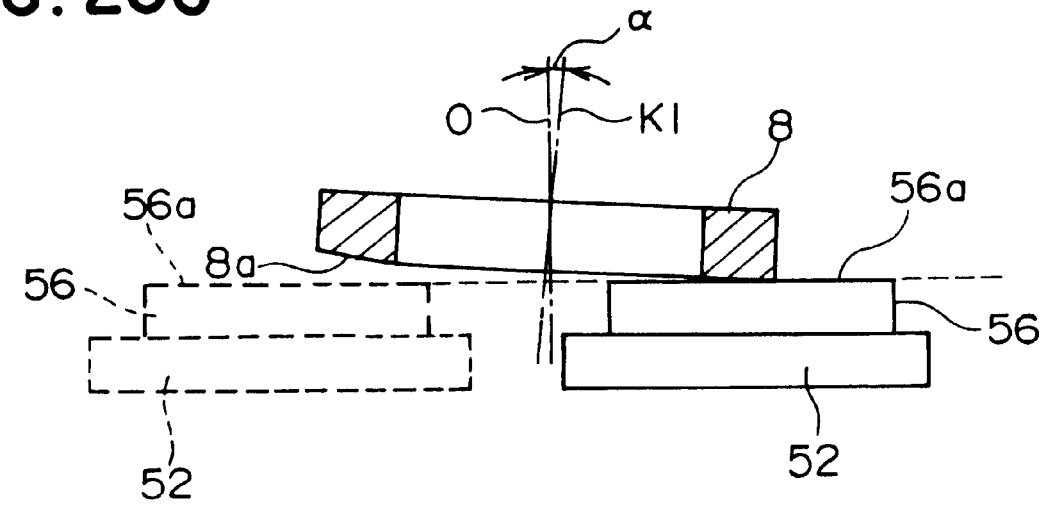

Then, as shown in FIG. 20C, the polishing surface 8*a* is formed by the facing by bringing the tip of the correction tool 56 into contact with the polishing surface 8*a* while relatively moving the X-axis table 52 with respect to the polishing tool 8 so that the shaft K1 of the polishing tool 8 passes the correction surface 56*a* of the correction tool 56.

The polishing surface 8*a* formed by such fading becomes a conical surface. The inclination angle of the generating line of this conical surface becomes the angle γ obtained by combining the angle α and the angle β as shown in FIGS. 19A and 19B, and the polishing surface 8*a* inclined with the angle γ is obtained.

Figure 21:
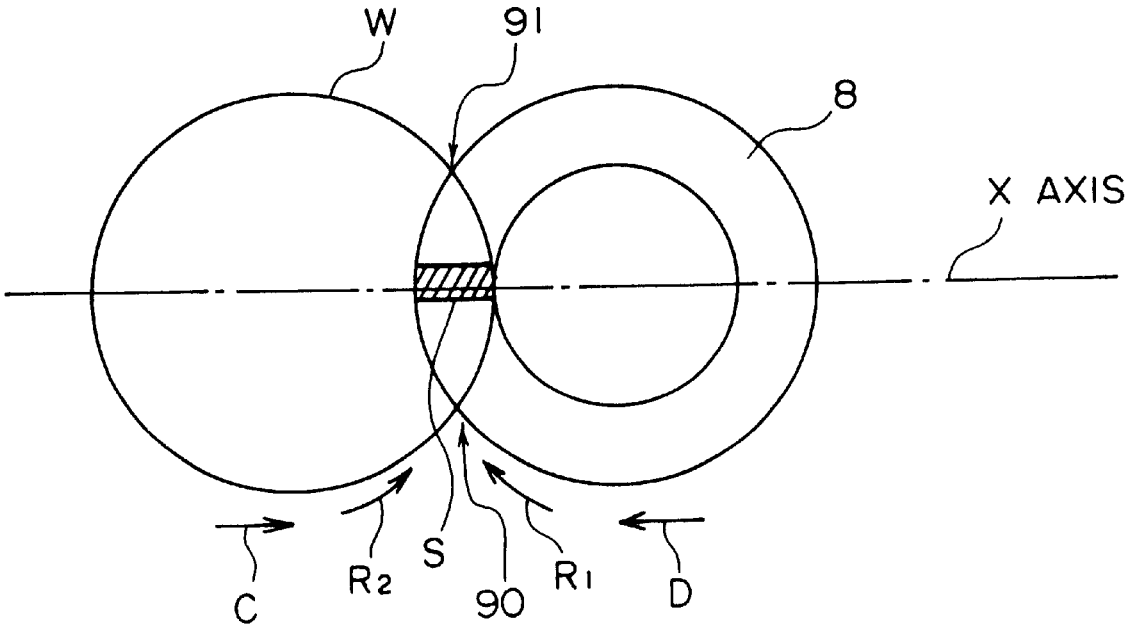
FIG. 21 is a view of the shape of an effective working region S of the wafer and the polishing surface.

When pressing the polishing surface 8*a* of the polishing tool 8 inclined by the angle γ against the wafer W, the polishing surface 8*a* contacts the surface of the wafer W approximately parallel. Further, as shown in FIG. 21, the shape of the effective working region S of the wafer W and the polishing surface 8*a* becomes a linear shape extending in the radial direction of the polishing tool 8. Further, the shape of this functional region S changes in accordance with the polishing pressure of the polishing tool 8 with respect to the wafer W and changes from the linear shape to a sector-form when the polishing pressure becomes large.

Further, since the shaft K1 of the polishing tool 8 is inclined by the inclination angle β in the direction reducing the elastic deformation, the position of the functional region S slightly shifts from the line in the X-axial direction passing through the center of the wafer W to the away region 91 side of the polishing surface 8*a* of the polishing tool 8 from the outer circumferential edge of the wafer W in accordance with this inclination angle β.

At this time, in the region 90 of the polishing tool 8 riding up on the outer circumferential edge of the wafer W and the relief region 91 of the polishing tool 8 from the outer circumferential edge of the wafer W, the polishing surface 8*a* of the polishing tool 8 is formed to a curved surface, therefore the height of the polishing surface 8*a* of the polishing tool 8 with respect to the surface of the wafer W becomes high compared with the height of the polishing surface 8*a* of the polishing tool 8 with respect to the surface of the wafer W in the working region S.

For this reason, even if the polishing tool 8 is pressed against the wafer W, the amount of elastic deformation of the polishing surface 8*a* of the polishing tool 8 in the riding region 90 becomes smaller than the case of the embodiment mentioned above, that is, the case where the polishing surface 8*a* is a plane.

Accordingly, the inclination angle β of the shaft K1 of the polishing tool 8 in the direction reducing the elastic deformation can be made smaller by the amount of the reduction of the amount of elastic deformation of the polishing surface 8*a* of the polishing tool 8.

As a result, the amount of the shift of the position of the working region S from the line in the X-axial direction passing through the center of the wafer W to the relief region 91 side of the polishing surface 8*a* of the polishing tool 8 from the outer circumferential edge of the wafer W can be suppressed as much as possible. For this reason, due to the relative movement of the wafer W and the polishing tool 8 in the X-axial direction, the working region S advances in the radial direction of the rotating wafer W and passes through the center of rotation of the wafer W, therefore the occurrence of insufficient polishing at the center of rotation of the wafer W can be prevented.

Further, according to the present embodiment, by inclining the polishing surface 8*a* of the polishing tool 8 by the angle γ obtained by combining the angle α and the angle β, the effective working region S of the polishing surface 8*a* of the polishing tool 8 and the surface to be polished of the wafer W is further made narrower, and the shape of the working region S is formed by the shape of the polishing surface 8*a* of the polishing tool 8, therefore the fluctuation of the surface area of the working region S is small, stabilization of the polishing rate becomes easier, and the followability of the working region S to warping or undulation in the surface of the wafer W is further improved, and the uniformity of polishing in the surface to be polished of the wafer W can be improved.

The present invention is not limited to these embodiments. In the embodiments, the explanation was made of the case where the entire surface to be polished of the wafer W was polished in the state with the shaft K1 of the polishing tool 8 was inclined in two different directions by the inclination angles β and β by the shaft inclination mechanism 61 of the polishing apparatus 1.

In the above embodiments, further, the shaft K1 of the polishing tool 8 was inclined by the inclination angle β toward the direction of advance D of the polishing tool 8, therefore when the polishing tool 8 was relatively moved up to a certain position with respect to the wafer W, elastic deformation due to the polishing surface 8*a* riding up on the outer circumferential edge of the wafer W does not occur or becomes very small in value. Note that the position of this polishing tool 8 with respect to the wafer W differs in accordance with the magnitude of the inclination angle β, the magnitude of the working pressure of the polishing tool 8 with respect to the wafer W, or the inclination angle of the polishing surface 8*a*.

For this reason, it is also possible to make the polishing tool 8 move relative to the wafer W up to the position where elastic deformation due to the polishing surface 8*a* riding up on the outer circumferential edge of the wafer W does not occur or becomes very small in value and then return the shaft K1 of the polishing tool 8 in a direction perpendicular to the holding surface 41*a* of the rotation table 41 with respect to the direction reducing the elastic deformation.

By eliminating the inclination of the shaft K1 of the polishing tool 8 in the direction reducing the elastic deformation in this way, the effective working region between the polishing surface 8*a* of the polishing tool 8 and the surface to be polished of the wafer W moving by relative movement of the polishing tool 8 and the wafer W in the X-axial direction moves along a line in the X-axial direction passing through the center of rotation of the wafer. Therefore, insufficient polishing of the center portion of the wafer W does not occur.

Note that, in order to return the shaft K1 of the polishing tool 8 to a direction perpendicular to the holding surface 41*a* of the rotation table 41 from the direction reducing the elastic deformation in the middle of the relative movement of the polishing tool 8 and the wafer W in the X-axial direction, it is possible to adjust the relative positions of the two inclination adjustment use blocks 62 and 63 of the shaft inclination mechanism 61 of the polishing apparatus 1 not manually but by for example a servo motor and a cylinder device and to drive them when the relative positions of the polishing tool 8 and the wafer W in the X-axial direction reach predetermined positions.

Summarizing the effect of the present invention, excessive polishing of the outer circumferential edge of the polished object due to elastic deformation in the region of the polishing surface of the polishing tool riding up on the outer circumferential edge of the polished object can be suppressed.

Further, by inclining the polishing surface of the polishing tool in two different directions, the effective working region can be made narrower, the feed of the abrasive between the polishing surface and the surface to be polished can be stabilized, and the uniformity of polishing at the surface to be polished can be improved.

While the invention has been described with reference to specific embodiment chosen for purpose of illustration, it should be apparent that numerous modifications could be made thereto by those skilled in the art without departing from the basic concept and scope of the invention.

What is claimed is:

1. A polishing method for a rotating polishing tool formed by an elastic member having a polishing surface along a plane perpendicular to a rotary shaft, pressing the polishing surface to a surface to be polished of an object to be polished held on a holding table, and relatively moving the object to be polished and the polishing tool along a holding surface of the holding table, to polish the surface of the object to be polished, said method comprising the steps of:

inclining the rotary shaft of the polishing-tool by a predetermined angle relative to a direction perpendicular to the holding surface of the holding table and toward a direction of advance of the movement of the polishing tool, and inclining the shaft of the polishing tool relative to the direction perpendicular to the holding surface of the holding table and in a direction corresponding to a rotational movement of a leading portion of the polishing tool with respect to the direction of advance for reducing elastic deformation of the polishing surface in a region where the polishing surface rides up on an edge of the surface of the object.

2. A polishing method as set forth in claim 1, further comprising a step of inclining the shaft along a plane perpendicular to the direction of advance of the movement of the polishing tool to reduce the elastic deformation of the polishing surface.

3. A polishing method as set forth in claim 2, further comprising a step of inclining the shaft in a direction where a height of the polishing surface relative to the surface to be polished in the region of the polishing surface riding up on an outer circumferential edge surface of the surface to be polished is higher than a height of the polishing surface in an away region of the surface to be polished that is located away from the outer circumferential edge of the surface to be polished.

4. A polishing method as set forth in claim 3, further comprising the steps of:

preparing said polishing tool, wherein said polish tool comprises a diameter approximately equal to a diameter of the surface of the object and used for polishing the object, positioning an outer circumferential edge of the polishing surface of the polishing tool outside the surface of the object, polishing the surface of the object while relatively moving the polishing tool in a direction where an area of of the polishing surface and the surface of the object overlap, and stopping the polishing at a position where the outer circumferential edge of the polishing surface of the polishing tool reaches the outer circumferential edge of the surface to be polished.

5. A polishing method as set forth in claim 1, further comprising a step of polishing by using a polishing tool having an annular polishing surface.

6. A polishing method as set forth in claim 5, further comprising a step of preparing the polishing too by rotating the polishing tool in a state with the shaft inclined in different directions and moving the polishing tool along a correction surface of a correction tool in a direction parallel to the holding surface.

7. A polishing method as set forth in claim 1, further comprising a step of making an inclination angle of said shaft toward the direction of advance of the polishing tool to the direction perpendicular to the holding surface of said holding table larger than the inclination angle of the direction reducing the elastic deformation of the polishing surface.

8. A polishing method as set forth in claim 1, further comprising a step of polishing while rotating said object to be polished.

9. A polishing method as set forth in claim 8, further comprising a step of polishing by making the directions of rotation of the object to be polished and polishing tool opposite.

10. A polishing method as set forth in claim 1, further comprising a step of polishing by interposing an abrasive between said polishing surface and said surface to be polished.

11. A polishing method as set forth in claim 2, further comprising a step of positioning an outer circumferential edge of the polishing surface of the polishing tool outside the surface of the object at an outer circumferential edge of said surface to be polished and, when polishing by moving the polishing tool in a direction in which an area of overlap of the polishing surface and surface to be polished increases, inclining the shaft along a plane perpendicular to the direction of advance of the movement of the polishing tool until at least reaching a position where the elastic deformation due to the polishing surface of the polishing tool rides up on the outer circumferential edge of the surface of the object.

12. A polishing method as set forth in claim 11, further comprising a step of making the shaft of the polishing tool perpendicular to the holding surface of the holding table for the direction of the plane perpendicular to the direction of advance the movement of the polishing tool when the polishing tool reaches a position where the elastic deformation due to the polishing surface of the polishing tool rides up on the outer circumferential edge surface of the surface to be polished.

13. A polishing method for a rotating polishing tool formed by an elastic member having a polishing surface along a plane perpendicular to a rotary shaft, pressing the polishing surface to a surface to be polished of an object to be polished held on a holding table, and relatively moving the object to be polished and the polishing tool along a holding surface of the holding table, to polish the surface of the object to be polished, said method comprising the steps of:

inclining the shaft of the polishing tool relative to a direction perpendicular to the holding surface of the holding table and in a direction corresponding to a rotational movement of a leading portion of the polishing tool with respect to a direction of advance for reducing elastic deformation of the polishing surface in a region where the polishing surface rides up on an edge of the polished surface.

14. A polishing method as set forth in claim 13, further comprising a step of rotating said object to be polished.

15. A polishing method as set forth in claim 14, further comprising a step of polishing by making the directions of rotation of the object to be polished and the polishing tool opposite.

16. A polishing method as set forth in claim 13, further comprising a step of polishing by using said polishing tool, wherein said polishing tool comprises an annular polishing surface.

17. A polishing method as set forth in claim 13, further comprising a step of inclining the shaft along a plane perpendicular to the direction of advance of the movement of the polishing tool.

18. A polishing method for polishing a surface to be polished of an object to be polished held on a holding table, comprising:

rotating a polishing tool formed by an elastic member having a polishing surface along a plane perpendicular to a rotary shaft, rotating the holding table and rotating said object to be polished, inclining the rotary shaft of the polishing tool by a predetermined angle to a direction perpendicular to a holding surface of the holding table and toward a direction of advance of movement of the polishing tool, and;

inclining the shaft of the polishing tool relative to the direction perpendicular to the holding surface of the holding table and in a direction corresponding to a rotational movement of a leading portion of the polishing tool with respect to the direction of advance for reducing elastic deformation of the polishing surface in a region where the polishing surface rides up on an edge of the polishing tool, pressing the polishing surface of the polishing tool to the surface to be polished of the object held on the holding table, and relatively moving the object and the polishing tool along a plane parallel to a holding surface of the holding table to polish the surface of the object.

19. A polishing method for a rotating polishing tool formed by an elastic member having a polishing surface along a plane perpendicular to a rotary shaft, pressing the polishing surface to a surface to be polished of an object to be polished held on a holding table, and relatively moving the object to be polished and the polishing tool along a holding surface of the holding table, to polish the surface of the object to be polished, said method comprising the steps of:

inclining the rotary shaft of the polishing tool by a predetermined angle to a direction perpendicular to the holding surface of the holding table and toward a direction of advance of the movement of the polishing tool, and inclining the shaft of the polishing tool to the direction perpendicular to the holding surface of the holding table and in a direction corresponding to a rotational movement of a leading portion of the polishing tool with respect to the direction of advance for reducing elastic deformation of the polishing surface in a region where the polishing surface rides up on an edge of the surface to be polished;

wherein the inclination angle of said shaft toward the direction of advance of the polishing tool relative to the direction perpendicular to the holding surface of said holding table is larger than the inclination angle of the direction that is a same direction as the rotational movement of the leading portion of the polishing tool with respect to the direction of advance.

20. A polishing method as set forth in claim 19, further comprising a step of inclining the shaft along a plane perpendicular to the direction of advance of the movement of the polishing tool to reduce the elastic deformation of the polishing surface.

21. A polishing method as set forth in claim 20, further comprising a step of inclining the shaft in a direction where a height of the polishing surface to the surface to be polished in the region of the polishing surface riding up on an outer circumferential edge surface of the surface to be polished becomes higher than a height of the polishing surface in an away region of the surface to be polished away from the outer circumferential edge of the surface to be polished.

22. A polishing method as set forth in claim 21, further comprising the steps of:

preparing said polishing tool, wherein said polishing tool comprises a diameter approximately equal to a diameter of the surface of the object and used for polishing the object, positioning an outer circumferential edge of the polishing surface of the polishing tool positioned outside the surface of the object, polishing the surface of the object while relatively moving the polishing tool in a direction where an area of overlap of the polishing surface and the surface of the object, and stopping the polishing at a position where the outer circumferential edge of the polishing surface of the polishing tool reaches the outer circumferential edge of the surface to be polished.

23. A polishing method as set forth in claim 19, further comprising a step of polishing by using said polishing tool, wherein said polishing tool comprises an annular polishing surface.

24. A polishing method as set forth in claim 23, further comprising a step of preparing said polishing tool, wherein said polishing tool comprises a polishing surface prepared by rotating the polishing tool in a state with the shaft inclined in different directions and moving along a correction.

25. A polishing method as set forth in claim 19, further comprising a step of polishing while rotating said object to be polished.

26. A polishing method as set forth in claim 25, further comprising a step of polishing by making the directions of rotation of the object to be polished and polishing tool opposite.

27. A polishing method as set forth in claim 19, further comprising a step of polishing by interposing an abrasive between said polishing surface and said surface to be polished.

* * * * *

UNITED STATES PATENT AND TRADEMARK OFFICE

CERTIFICATE OF CORRECTION

PATENT NO. : 6,511,362 B1
DATED : January 28, 2003
INVENTOR(S) : Yoshifumi Akaike It is certified that error appears in the above-identified patent and that said Letters Patent is hereby corrected as shown below:

Column 21,
Line 10, “a polishing tool” should read -- said polishing tool, wherein said polishing tool comprises --.
Line 12, “too by” should read -- tool by --.

Signed and Sealed this

Twenty-second Day of November, 2005

JON W. DUDAS
*Director of the United States Patent and Trademark Office*